US010678175B2

(12) United States Patent
Tabata et al.

(10) Patent No.: US 10,678,175 B2
(45) Date of Patent: Jun. 9, 2020

(54) IMAGE FORMING DEVICE

(71) Applicant: Konica Minolta, Inc., Chiyoda-ku, Tokyo (JP)

(72) Inventors: Eiji Tabata, Ibaraki (JP); Nofumi Mizumoto, Nara (JP); Makiko Watanabe, Uji (JP); Shigeo Uetake, Higashiyamato (JP); Toshiya Natsuhara, Takarazuka (JP)

(73) Assignee: KONICA MINOLTA, INC., Tokyo (JP)

( * ) Notice: Subject to any disclaimer, the term of this patent is extended or adjusted under 35 U.S.C. 154(b) by 1 day.

(21) Appl. No.: 16/118,158

(22) Filed: Aug. 30, 2018

(65) Prior Publication Data

US 2019/0094780 A1 Mar. 28, 2019

(30) Foreign Application Priority Data

Sep. 25, 2017 (JP) ..... 2017-183670

(51) Int. Cl.
*G03G 15/16* (2006.01)
*G03G 15/00* (2006.01)

(52) U.S. Cl.
CPC ..... *G03G 15/5029* (2013.01); *G03G 15/1605* (2013.01); *G03G 15/1615* (2013.01); *G03G 15/6517* (2013.01)

(58) Field of Classification Search
CPC ..... G03G 15/1605; G03G 15/5029
See application file for complete search history.

(56) References Cited

U.S. PATENT DOCUMENTS 4,931,839 A * 6/1990 Tompkins ..... G03G 15/0131 399/101
5,486,903 A * 1/1996 Kanno ..... G03G 15/5029 399/322

(Continued)

FOREIGN PATENT DOCUMENTS

| | | |
|---|---|---|
| JP | H06-161307 | 6/1994 |
| JP | 2012-163730 | 8/2012 |
| JP | 2014-134718 | 7/2014 |

*Primary Examiner* — David J Bolduc
(74) *Attorney, Agent, or Firm* — Squire Patton Boggs (US) LLP

(57) ABSTRACT

An image forming device includes: an endless intermediate transfer belt; and a secondary transferrer, wherein the secondary transferrer includes a secondary transfer roller and a counter roller, a value calculated from $w/V_{sys}$ is defined as a nip time N [sec], when the secondary transferrer is deemed as an equivalent circuit including a resistance R1 [$\Omega \cdot m^2$] of the secondary transfer roller, a resistance R2 [$\Omega \cdot m^2$] of the intermediate transfer belt, a resistance R3 [$\Omega \cdot m^2$] of the counter roller, and capacitance $C_{med}$ [$F/m^2$] of a recording medium, in a case where a combined resistance in the equivalent circuit is defined as $R_{total}$ [$\Omega \cdot m^2$], and combined capacitance in the equivalent circuit is defined as $C_{total}$ [$F/m^2$], a value calculated from $R_{total} \times C_{total}$ is defined as a time constant $\tau$ [sec], and the image forming device further includes: a sheet detector; and a hardware processor.

20 Claims, 24 Drawing Sheets

(56) References Cited

U.S. PATENT DOCUMENTS 5,557,384 A * 9/1996 Takano ..... G03G 15/1605 399/313
5,742,888 A * 4/1998 Fuchiwaki ..... G03G 15/1605 399/308
6,061,543 A * 5/2000 Kayahara ..... G03G 15/167 399/298
6,999,710 B2 * 2/2006 Kasahara ..... G03G 15/206 399/307
7,200,345 B2 * 4/2007 Katayanagi ..... G03G 15/206 399/329
2002/0168193 A1 * 11/2002 Weaver ..... B65H 43/00 399/45
2003/0118360 A1 * 6/2003 Joichi ..... G03G 15/5029 399/45
2004/0114978 A1 * 6/2004 Iwakura ..... G03G 15/6558 399/388
2007/0025780 A1 * 2/2007 Kurosu ..... G03G 15/16 399/313
2007/0212126 A1 * 9/2007 Seto ..... G03G 15/167 399/302
2007/0231034 A1 * 10/2007 Yasui ..... G03G 15/231 399/401
2008/0205918 A1 * 8/2008 Murakami ..... G03G 15/5029 399/45
2009/0003857 A1 * 1/2009 Kuramochi ..... B65H 7/02 399/45
2009/0175641 A1 * 7/2009 Mizushima ..... G03G 15/1605 399/51
2009/0207461 A1 * 8/2009 Hodoshima ..... G03G 15/5029 358/498
2010/0034565 A1 * 2/2010 Ashikawa ..... G03G 15/0131 399/302
2010/0074641 A1 * 3/2010 Takenaka ..... G03G 15/161 399/66
2010/0135703 A1 * 6/2010 Nakamura ..... G03G 15/1675 399/313
2010/0232845 A1 * 9/2010 Kamijo ..... G03G 15/1605 399/313
2010/0260512 A1 * 10/2010 Imamura ..... G03G 15/0131 399/66
2010/0303488 A1 * 12/2010 Yanagi ..... G03G 15/065 399/45
2010/0316398 A1 * 12/2010 Boyatt, III ..... G03G 15/657 399/44
2011/0013950 A1 * 1/2011 Furuya ..... G03G 15/167 399/302
2011/0033213 A1 * 2/2011 Nakamura ..... G03G 15/1685 399/313
2011/0058830 A1 * 3/2011 Saka ..... G03G 15/167 399/45
2011/0091256 A1 * 4/2011 Nozawa ..... G03G 15/167 399/388
2011/0110676 A1 * 5/2011 Higa ..... G03G 15/1675 399/49
2011/0280602 A1 * 11/2011 Takenaka ..... G03G 15/065 399/45
2011/0293306 A1 * 12/2011 Matsumoto ..... G03G 15/1605 399/66
2011/0318070 A1 * 12/2011 Whitney ..... G03G 15/1685 399/313
2012/0027442 A1 * 2/2012 Torimaru ..... G03G 15/161 399/44
2012/0121293 A1 * 5/2012 Mimbu ..... G03G 15/161 399/121
2012/0155903 A1 * 6/2012 Adachi ..... G03G 15/161 399/66
2012/0207494 A1 * 8/2012 Tomura ..... G03G 15/0189 399/40
2012/0230715 A1 * 9/2012 Ogino ..... G03G 15/1605 399/66
2012/0243892 A1 * 9/2012 Nakamura ..... G03G 15/1675 399/66
2013/0136509 A1 * 5/2013 Suzuki ..... G03G 15/1605 399/302
2013/0315612 A1 * 11/2013 Nishisaka ..... G03G 15/16 399/45
2014/0119759 A1 * 5/2014 Yamaura ..... G03G 15/168 399/66
2014/0199089 A1 * 7/2014 Ishikawa ..... G03G 15/1605 399/45
2014/0241744 A1 * 8/2014 Ichikawa ..... G03G 15/1615 399/66
2014/0248064 A1 * 9/2014 Tanaka ..... G03G 15/1675 399/66
2014/0294408 A1 * 10/2014 Yoshioka ..... G03G 15/0136 399/44
2014/0294411 A1 * 10/2014 Yoshioka ..... G03G 15/1695 399/45
2015/0037053 A1 * 2/2015 Ishida ..... G03G 15/5029 399/45
2015/0220024 A1 * 8/2015 Yoshioka ..... G03G 15/1605 399/101
2015/0277299 A1 * 10/2015 Nishisaka ..... G03G 15/1615 399/45
2015/0293487 A1 * 10/2015 Takenaga ..... G03G 15/5029 356/73
2016/0004193 A1 * 1/2016 Murrell ..... H04N 1/00724 399/67
2016/0109832 A1 * 4/2016 Ohsugi ..... G03G 15/162
2016/0161888 A1 * 6/2016 Wada ..... G03G 15/1665 399/66
2016/0170364 A1 * 6/2016 Kogure ..... G03G 15/161 399/316
2016/0259284 A1 * 9/2016 Fujiwara ..... G03G 15/6558
2016/0274504 A1 * 9/2016 Wada ..... G03G 15/6591
2016/0334739 A1 * 11/2016 Ohsugi ..... G03G 15/1605
2017/0160680 A1 * 6/2017 Oura ..... G03G 15/1615
2017/0299987 A1 * 10/2017 Sugimoto ..... G03G 15/1605
2018/0093841 A1 * 4/2018 Momose ..... B65H 5/064
2018/0095376 A1 * 4/2018 Tabata ..... G03G 15/0163
2018/0253039 A1 * 9/2018 Kakehi ..... G03G 15/5029
2018/0307171 A1 * 10/2018 Satsukawa ..... G03G 15/5029
2018/0373182 A1 * 12/2018 Mandai ..... G03G 15/1675

* cited by examiner

FIG. 20

| RECORDING MEDIUM | | | PROCESS SETTING | | SECONDARY TRANSFER MEMBER CIRCUIT CHARACTERISTIC VALUES | | | INDEX VALUE | IMAGE OUTPUT RESULT | |
|---|---|---|---|---|---|---|---|---|---|---|
| MATERIAL | THICKNESS [μm] | CAPACITANCE [μF/m²] | SYSTEM SPEED [mm/s] | NIP TIME [msec] | COMBINED CAPACITANCE [μF/m²] | COMBINED RESISTANCE [Ω·m²] | TIME CONSTANT [msec] | NIP TIME/ TIME CONSTANT [-] | TRANSFER EFFICIENCY | EVALUATION |
| PET | 12 | 2.43 | 150 | 25.3 | 0.86 | 5.8×10^3 | 4.99 | 5.1 | 96% | GOOD |
| PET | 23 | 1.27 | 200 | 19.0 | 0.65 | 5.8×10^3 | 3.77 | 5.0 | 95% | GOOD |
| PET | 50 | 0.58 | 300 | 12.7 | 0.41 | 5.8×10^3 | 2.35 | 5.4 | 98% | GOOD |
| PET | 50 | 0.58 | 400 | 9.5 | 0.41 | 5.8×10^3 | 2.35 | 4.0 | 92% | ALLOWABLE |
| PET | 75 | 0.39 | 400 | 9.5 | 0.30 | 5.8×10^3 | 1.75 | 5.4 | 98% | GOOD |
| PET | 100 | 0.29 | 400 | 9.5 | 0.24 | 5.8×10^3 | 1.39 | 6.8 | 96% | GOOD |
| PP | 20 | 1.02 | 200 | 19.0 | 0.58 | 5.8×10^3 | 3.34 | 5.7 | 98% | GOOD |
| PP | 25 | 0.81 | 300 | 12.7 | 0.51 | 5.8×10^3 | 2.93 | 4.3 | 98% | GOOD |
| PP | 50 | 0.41 | 400 | 9.5 | 0.31 | 5.8×10^3 | 1.81 | 5.3 | 98% | GOOD |
| PP | 60 | 0.34 | 400 | 9.5 | 0.27 | 5.8×10^3 | 1.57 | 6.1 | 98% | GOOD |

FIG. 21

| RECORDING MEDIUM | | | PROCESS SETTING | | SECONDARY TRANSFER MEMBER CIRCUIT CHARACTERISTIC VALUES | | | INDEX VALUE | IMAGE OUTPUT RESULT | |
|---|---|---|---|---|---|---|---|---|---|---|
| MATERIAL | THICKNESS [μm] | CAPACITANCE [μF/m²] | SYSTEM SPEED [mm/s] | NIP TIME [msec] | COMBINED CAPACITANCE [μF/m²] | COMBINED RESISTANCE [Ω·m²] | TIME CONSTANT [msec] | NIP TIME/ TIME CONSTANT [-] | TRANSFER EFFICIENCY | EVALUATION |
| PET | 12 | 2.43 | 400 | 9.5 | 0.86 | 5.8×10^3 | 4.99 | 1.9 | 53% | NO GOOD |
| PET | 23 | 1.27 | 400 | 9.5 | 0.65 | 5.8×10^3 | 3.77 | 2.5 | 65% | NO GOOD |
| PP | 20 | 1.02 | 400 | 9.5 | 0.58 | 5.8×10^3 | 3.34 | 2.8 | 65% | NO GOOD |
| PP | 25 | 0.81 | 400 | 9.5 | 0.51 | 5.8×10^3 | 2.93 | 3.2 | 83% | NO GOOD |

FIG. 22

| RECORDING MEDIUM | | | PROCESS SETTING | | SECONDARY TRANSFER MEMBER CIRCUIT CHARACTERISTIC VALUES | | | INDEX VALUE | IMAGE OUTPUT RESULT | |
|---|---|---|---|---|---|---|---|---|---|---|
| MATERIAL | THICKNESS [μm] | CAPACITANCE [μF/m²] | SECONDARY TRANSFER ROLLER DIA. [mm] | NIP TIME [msec] | COMBINED CAPACITANCE [μF/m²] | COMBINED RESISTANCE [Ω·m²] | TIME CONSTANT [msec] | NIP TIME/ TIME CONSTANT [-] | TRANSFER EFFICIENCY | EVALUATION |
| PET | 12 | 2.43 | 100 | 18.8 | 0.86 | 5.8×10^3 | 4.99 | 3.8 | 91% | ALLOWABLE |
| PET | 23 | 1.27 | 100 | 18.8 | 0.65 | 5.8×10^3 | 3.77 | 5.0 | 96% | GOOD |
| PET | 50 | 0.58 | 100 | 18.8 | 0.41 | 5.8×10^3 | 2.35 | 8.0 | 98% | GOOD |
| PET | 75 | 0.39 | 40 | 9.5 | 0.30 | 5.8×10^3 | 1.75 | 5.4 | 98% | GOOD |
| PET | 100 | 0.29 | 40 | 9.5 | 0.24 | 5.8×10^3 | 1.39 | 6.8 | 96% | GOOD |
| PP | 20 | 1.02 | 100 | 18.8 | 0.58 | 5.8×10^3 | 3.34 | 5.6 | 98% | GOOD |
| PP | 25 | 0.81 | 100 | 18.8 | 0.51 | 5.8×10^3 | 2.93 | 6.4 | 98% | GOOD |
| PP | 50 | 0.41 | 40 | 9.5 | 0.31 | 5.8×10^3 | 1.81 | 5.3 | 98% | GOOD |
| PP | 60 | 0.34 | 40 | 9.5 | 0.27 | 5.8×10^3 | 1.57 | 6.1 | 98% | GOOD |

FIG. 23

| RECORDING MEDIUM | | | PROCESS SETTING | | SECONDARY TRANSFER MEMBER CIRCUIT CHARACTERISTIC VALUES | | | INDEX VALUE | IMAGE OUTPUT RESULT | |
|---|---|---|---|---|---|---|---|---|---|---|
| MATERIAL | THICKNESS [μm] | CAPACITANCE [μF/m²] | SECONDARY TRANSFER ROLLER HARDNESS [deg.] | NIP TIME [msec] | COMBINED CAPACITANCE [μF/m²] | COMBINED RESISTANCE [Ω·m²] | TIME CONSTANT [msec] | NIP TIME/ TIME CONSTANT [-] | TRANSFER EFFICIENCY | EVALUATION |
| PET | 12 | 2.43 | 23 | 19.3 | 0.86 | 5.8×10^3 | 4.99 | 3.9 | 92% | ALLOWABLE |
| PET | 23 | 1.27 | 23 | 19.3 | 0.65 | 5.8×10^3 | 3.77 | 5.1 | 97% | GOOD |
| PET | 50 | 0.58 | 23 | 19.3 | 0.41 | 5.8×10^3 | 2.35 | 8.2 | 98% | GOOD |
| PET | 75 | 0.39 | 40 | 9.5 | 0.30 | 5.8×10^3 | 1.75 | 5.4 | 98% | GOOD |
| PET | 100 | 0.29 | 40 | 9.5 | 0.24 | 5.8×10^3 | 1.39 | 6.8 | 96% | GOOD |
| PP | 20 | 1.02 | 23 | 19.3 | 0.58 | 5.8×10^3 | 3.34 | 5.8 | 97% | GOOD |
| PP | 25 | 0.81 | 23 | 19.3 | 0.51 | 5.8×10^3 | 2.93 | 6.6 | 97% | GOOD |
| PP | 50 | 0.41 | 40 | 9.5 | 0.31 | 5.8×10^3 | 1.81 | 5.3 | 98% | GOOD |
| PP | 60 | 0.34 | 40 | 9.5 | 0.27 | 5.8×10^3 | 1.57 | 6.1 | 98% | GOOD |

FIG. 24

| RECORDING MEDIUM | | | PROCESS SETTING | | SECONDARY TRANSFER MEMBER CIRCUIT CHARACTERISTIC VALUES | | | INDEX VALUE | IMAGE OUTPUT RESULT | |
|---|---|---|---|---|---|---|---|---|---|---|
| MATERIAL | THICKNESS [μm] | CAPACITANCE [μF/m²] | NIP TIME [msec] | DIELECTRIC SHEET | COMBINED CAPACITANCE [μF/m²] | COMBINED RESISTANCE [Ω·m²] | TIME CONSTANT [msec] | NIP TIME/ TIME CONSTANT [-] | TRANSFER EFFICIENCY | EVALUATION |
| PET | 12 | 2.43 | 9.5 | YES | 0.34 | 5.8×10^3 | 1.95 | 4.9 | 96% | GOOD |
| PET | 23 | 1.27 | 9.5 | YES | 0.30 | 5.8×10^3 | 1.73 | 5.5 | 95% | GOOD |
| PET | 50 | 0.58 | 9.5 | YES | 0.23 | 5.8×10^3 | 1.35 | 7.0 | 95% | GOOD |
| PET | 75 | 0.39 | 9.5 | NO | 0.30 | 5.8×10^3 | 1.75 | 5.4 | 98% | GOOD |
| PET | 100 | 0.29 | 9.5 | NO | 0.24 | 5.8×10^3 | 1.39 | 6.8 | 96% | GOOD |
| PP | 20 | 1.02 | 9.5 | YES | 0.28 | 5.8×10^3 | 1.63 | 5.8 | 95% | GOOD |
| PP | 25 | 0.81 | 9.5 | YES | 0.26 | 5.8×10^3 | 1.53 | 6.2 | 95% | GOOD |
| PP | 50 | 0.41 | 9.5 | NO | 0.31 | 5.8×10^3 | 1.81 | 5.3 | 98% | GOOD |
| PP | 60 | 0.34 | 9.5 | NO | 0.27 | 5.8×10^3 | 1.57 | 6.1 | 98% | GOOD |

FIG. 25

| RECORDING MEDIUM | | | PROCESS SETTING | | SECONDARY TRANSFER MEMBER CIRCUIT CHARACTERISTIC VALUES | | | INDEX VALUE | IMAGE OUTPUT RESULT | |
|---|---|---|---|---|---|---|---|---|---|---|
| MATERIAL | THICKNESS [μm] | CAPACITANCE [μF/m²] | NIP TIME [msec] | DIELECTRIC MATERIAL APPLICATION | COMBINED CAPACITANCE [μF/m²] | COMBINED RESISTANCE [Ω·m²] | TIME CONSTANT [msec] | NIP TIME/ TIME CONSTANT [-] | TRANSFER EFFICIENCY | EVALUATION |
| PP | 20 | 1.02 | 9.5 | YES | 0.42 | 5.8×10^3 | 2.44 | 3.9 | 92% | ALLOWABLE |
| PP | 25 | 0.81 | 9.5 | YES | 0.38 | 5.8×10^3 | 2.21 | 4.3 | 95% | GOOD |
| PP | 50 | 0.41 | 9.5 | NO | 0.31 | 5.8×10^3 | 1.81 | 5.3 | 98% | GOOD |
| PP | 60 | 0.34 | 9.5 | NO | 0.27 | 5.8×10^3 | 1.57 | 6.1 | 98% | GOOD |

FIG. 26

| RECORDING MEDIUM | | | PROCESS SETTING | | SECONDARY TRANSFER MEMBER CIRCUIT CHARACTERISTIC VALUES | | | INDEX VALUE | IMAGE OUTPUT RESULT | |
|---|---|---|---|---|---|---|---|---|---|---|
| MATERIAL | THICKNESS [μm] | CAPACITANCE [μF/m²] | SECONDARY TRANSFER ROLLER RESISTANCE | NIP TIME [msec] | COMBINED CAPACITANCE [μF/m²] | COMBINED RESISTANCE [Ω·m²] | TIME CONSTANT [msec] | NIP TIME/ TIME CONSTANT [-] | TRANSFER EFFICIENCY | EVALUATION |
| PET | 12 | 2.43 | LOW | 9.5 | 0.86 | 2.8×10^3 | 2.41 | 3.9 | 90% | GOOD |
| PET | 23 | 1.27 | LOW | 9.5 | 0.65 | 2.8×10^3 | 1.82 | 5.2 | 98% | GOOD |
| PET | 50 | 0.58 | LOW | 9.5 | 0.41 | 2.8×10^3 | 1.14 | 8.4 | 98% | GOOD |
| PET | 75 | 0.39 | STANDARD | 9.5 | 0.30 | 5.8×10^3 | 1.75 | 5.4 | 98% | GOOD |
| PET | 100 | 0.29 | STANDARD | 9.5 | 0.24 | 5.8×10^3 | 1.39 | 6.8 | 96% | GOOD |
| PP | 20 | 1.02 | LOW | 9.5 | 0.58 | 2.8×10^3 | 1.61 | 5.9 | 98% | GOOD |
| PP | 25 | 0.81 | LOW | 9.5 | 0.51 | 2.8×10^3 | 1.41 | 6.7 | 98% | GOOD |
| PP | 50 | 0.41 | STANDARD | 9.5 | 0.31 | 5.8×10^3 | 1.81 | 5.3 | 98% | GOOD |
| PP | 60 | 0.34 | STANDARD | 9.5 | 0.27 | 5.8×10^3 | 1.57 | 6.1 | 98% | GOOD |

FIG. 27

| RECORDING MEDIUM | | | PROCESS SETTING | | SECONDARY TRANSFER MEMBER CIRCUIT CHARACTERISTIC VALUES | | | INDEX VALUE | IMAGE OUTPUT RESULT | |
|---|---|---|---|---|---|---|---|---|---|---|
| MATERIAL | THICKNESS [μm] | CAPACITANCE [μF/m²] | INSERTION RESISTANCE [Ω] | NIP TIME [msec] | COMBINED CAPACITANCE [μF/m²] | COMBINED RESISTANCE [Ω·m²] | TIME CONSTANT [msec] | NIP TIME/ TIME CONSTANT [-] | TRANSFER EFFICIENCY | EVALUATION |
| PET | 12 | 2.43 | 100k | 9.5 | 0.86 | 2.7×10^3 | 2.32 | 4.1 | 98% | GOOD |
| PET | 23 | 1.27 | 100k | 9.5 | 0.65 | 2.7×10^3 | 1.75 | 5.4 | 98% | GOOD |
| PET | 50 | 0.58 | 1M | 9.5 | 0.41 | 4.2×10^3 | 1.70 | 5.6 | 98% | GOOD |
| PET | 75 | 0.39 | 1M | 9.5 | 0.30 | 4.2×10^3 | 1.26 | 7.5 | 98% | GOOD |
| PET | 50 | 0.58 | 2M | 9.5 | 0.41 | 5.5×10^3 | 2.23 | 4.3 | 98% | GOOD |
| PET | 75 | 0.39 | 2M | 9.5 | 0.30 | 5.5×10^3 | 1.65 | 5.7 | 98% | GOOD |
| PET | 100 | 0.29 | 2M | 9.5 | 0.24 | 5.5×10^3 | 1.31 | 7.2 | 98% | GOOD |

FIG. 28

| RECORDING MEDIUM | | | PROCESS SETTING | | SECONDARY TRANSFER MEMBER CIRCUIT CHARACTERISTIC VALUES | | | INDEX VALUE | IMAGE OUTPUT RESULT | |
|---|---|---|---|---|---|---|---|---|---|---|
| MATERIAL | THICKNESS [μm] | CAPACITANCE [μF/m²] | INSERTION RESISTANCE [Ω] | NIP TIME [msec] | COMBINED CAPACITANCE [μF/m²] | COMBINED RESISTANCE [Ω·m²] | TIME CONSTANT [msec] | NIP TIME/ TIME CONSTANT [-] | TRANSFER EFFICIENCY | EVALUATION |
| PET | 12 | 2.43 | 2M | 9.5 | 0.86 | 5.5×10^3 | 4.72 | 2.0 | 60% | NO GOOD |
| PET | 23 | 1.27 | 2M | 9.5 | 0.65 | 5.5×10^3 | 3.56 | 2.7 | 72% | NO GOOD |

FIG. 29

| RECORDING MEDIUM | | | PROCESS SETTING | | | SECONDARY TRANSFER MEMBER CIRCUIT CHARACTERISTIC VALUES | | | INDEX VALUE | IMAGE OUTPUT RESULT | |
|---|---|---|---|---|---|---|---|---|---|---|---|
| MATERIAL | THICKNESS [μm] | CAPACITANCE [μF/m²] | SECONDARY TRANSFER ROLLER DIA. [mm] | SECOND TRANSFER ROLLER RESISTANCE | NIP TIME [msec] | COMBINED CAPACITANCE [μF/m²] | COMBINED RESISTANCE [Ω·m²] | TIME CONSTANT [msec] | NIP TIME/ TIME CONSTANT [-] | TRANSFER EFFICIENCY | EVALUATION |
| PET | 12 | 2.43 | 80 | SEMI-LOW | 17.0 | 0.86 | 3.7×10^3 | 3.18 | 5.3 | 91% | GOOD |
| PET | 23 | 1.27 | 80 | SEMI-LOW | 17.0 | 0.65 | 3.7×10^3 | 2.40 | 7.1 | 96% | GOOD |
| PET | 50 | 0.58 | 80 | SEMI-LOW | 17.0 | 0.41 | 3.7×10^3 | 1.50 | 11.3 | 98% | GOOD |
| PET | 75 | 0.39 | 40 | STANDARD | 9.5 | 0.30 | 5.8×10^3 | 1.75 | 5.4 | 98% | GOOD |
| PET | 100 | 0.29 | 40 | STANDARD | 9.5 | 0.24 | 5.8×10^3 | 1.39 | 6.8 | 96% | GOOD |
| PP | 20 | 1.02 | 80 | SEMI-LOW | 17.0 | 0.58 | 3.7×10^3 | 2.13 | 8.0 | 98% | GOOD |
| PP | 25 | 0.81 | 80 | SEMI-LOW | 17.0 | 0.51 | 3.7×10^3 | 1.87 | 9.1 | 98% | GOOD |
| PP | 50 | 0.41 | 40 | STANDARD | 9.5 | 0.31 | 5.8×10^3 | 1.81 | 5.3 | 98% | GOOD |
| PP | 60 | 0.34 | 40 | STANDARD | 9.5 | 0.27 | 5.8×10^3 | 1.57 | 6.1 | 98% | GOOD |

FIG. 30

| RECORDING MEDIUM | | | PROCESS SETTING | | SECONDARY TRANSFER MEMBER CIRCUIT CHARACTERISTIC VALUES | | | INDEX VALUE | IMAGE OUTPUT RESULT | |
|---|---|---|---|---|---|---|---|---|---|---|
| MATERIAL | THICKNESS [μm] | CAPACITANCE [μF/m²] | SYSTEM SPEED [mm/s] | NIP TIME [msec] | COMBINED CAPACITANCE [μF/m²] | COMBINED RESISTANCE [Ω·m²] | TIME CONSTANT [msec] | NIP TIME/ TIME CONSTANT [-] | TRANSFER EFFICIENCY | EVALUATION |
| PET | 12 | 2.43 | 150 | 25.3 | 0.86 | 5.8×10^3 | 4.99 | 5.1 | 96% | GOOD |
| PET | 12 | 2.43 | 200 | 19.0 | 0.86 | 5.8×10^3 | 4.99 | 3.8 | 91% | ALLOWABLE |
| PET | 23 | 1.27 | 150 | 25.3 | 0.65 | 5.8×10^3 | 3.77 | 6.7 | 96% | GOOD |
| PET | 23 | 1.27 | 200 | 19.0 | 0.65 | 5.8×10^3 | 3.77 | 5.0 | 95% | GOOD |
| PET | 23 | 1.27 | 260 | 14.6 | 0.65 | 5.8×10^3 | 3.77 | 3.9 | 91% | ALLOWABLE |

FIG. 31

| RECORDING MEDIUM | | | PROCESS SETTING | | SECONDARY TRANSFER MEMBER CIRCUIT CHARACTERISTIC VALUES | | | INDEX VALUE | IMAGE OUTPUT RESULT | |
|---|---|---|---|---|---|---|---|---|---|---|
| MATERIAL | THICKNESS [μm] | CAPACITANCE [μF/m²] | SYSTEM SPEED [mm/s] | NIP TIME [msec] | COMBINED CAPACITANCE [μF/m²] | COMBINED RESISTANCE [Ω·m²] | TIME CONSTANT [msec] | NIP TIME/ TIME CONSTANT [-] | TRANSFER EFFICIENCY | EVALUATION |
| PET | 12 | 2.43 | 230 | 16.5 | 0.86 | 5.8×10^3 | 4.99 | 3.3 | 79% | NO GOOD |
| PET | 12 | 2.43 | 300 | 12.7 | 0.86 | 5.8×10^3 | 4.99 | 2.5 | 61% | NO GOOD |
| PET | 23 | 1.27 | 300 | 12.7 | 0.65 | 5.8×10^3 | 3.77 | 3.4 | 80% | NO GOOD |
| PET | 23 | 1.27 | 400 | 9.5 | 0.65 | 5.8×10^3 | 3.77 | 2.5 | 65% | NO GOOD |

IMAGE FORMING DEVICE

The entire disclosure of Japanese patent Application No. 2017-183670, filed on Sep. 25, 2017, is incorporated herein by reference in its entirety.

BACKGROUND

Technological Field

The present invention relates to an image forming device.

Description of the Related Art

In an image forming device, there are disclosed techniques in which transferability of a toner image to a recording medium is secured for various kinds of recording media which are different in thicknesses, materials, and the like (JP 6-161307 A, JP 2012-163730 A, and JP 2014-134718 A).

However, there is still a demand to secure good transferability for various kinds of recording media.

SUMMARY

An object according to an embodiment of the present invention is to provide an image forming device capable of securing good transferability for various kinds of recording media which are different in thicknesses, materials, and the like.

To achieve the abovementioned object, according to an aspect of the present invention, an image forming device reflecting one aspect of the present invention comprises: an endless intermediate transfer belt; and a secondary transferrer that transfers a toner image carried by the intermediate transfer belt to a recording medium, wherein the secondary transferrer includes a secondary transfer roller and a counter roller that faces the secondary transfer roller and forms a secondary transfer nip, a value calculated from $w/V_{sys}$ by using a length w [mm] of the secondary transfer nip in a conveyance direction of the recording medium and a system speed $V_{sys}$ [mm/sec] is defined as a nip time N [sec], when the secondary transferrer is deemed as an equivalent circuit including a resistance R1 [$\Omega \cdot m^2$] of the secondary transfer roller, a resistance R2 [$\Omega \cdot m^2$] of the intermediate transfer belt, a resistance R3 [$\Omega \cdot m^2$] of the counter roller, and capacitance $C_{med}$ [$F/m^2$] of the recording medium, in a case where a combined resistance in the equivalent circuit is defined as $R_{total}$ [$\Omega \cdot m^2$], and combined capacitance in the equivalent circuit is defined as $C_{total}$ [$F/m^2$], a value calculated from $R_{total} \times C_{total}$ by using the combined resistance $R_{total}$ and the combined capacitance $C_{total}$ is defined as a time constant $\tau$ [sec], and the image forming device further comprises: a sheet detector that acquires capacitance of the recording medium; and a hardware processor that adjusts at least one of the nip time and the time constant in accordance with the capacitance of the recording medium acquired by the sheet detector.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 20 is a table illustrating evaluation results of Example 1;

FIG. 21 is a table illustrating evaluation results of Comparative Example 1;

FIG. 22 is a table illustrating evaluation results of Example 2;

FIG. 23 is a table illustrating evaluation results of Example 3;

FIG. 24 is a table illustrating evaluation results of Example 4;

FIG. 25 is a table illustrating evaluation results of Example 5;

FIG. 26 is a table illustrating evaluation results of Example 6;

FIG. 27 is a table illustrating evaluation results of Example 7;

FIG. 28 is a table illustrating evaluation results of Comparative Example 2;

FIG. 29 is a table illustrating evaluation results of Example 8;

FIG. 30 is a table illustrating evaluation results of Example 9; and

FIG. 31 is a table illustrating evaluation results of Comparative Example 3.

DETAILED DESCRIPTION OF EMBODIMENTS

Hereinafter, one or more embodiments of the present invention will be described with reference to the drawings. However, the scope of the invention is not limited to the disclosed embodiments.

In the following, an image forming device 2 according to each of embodiments will be described with reference to the drawings. In the following embodiments, a component that is identical or substantially equivalent will be denoted by the same reference sign, and the same description will not be repeated. The respective components in the respective embodiments described below may be selectively combined as appropriate.

First Embodiment

<Image Forming Device 2>

Figure 1:
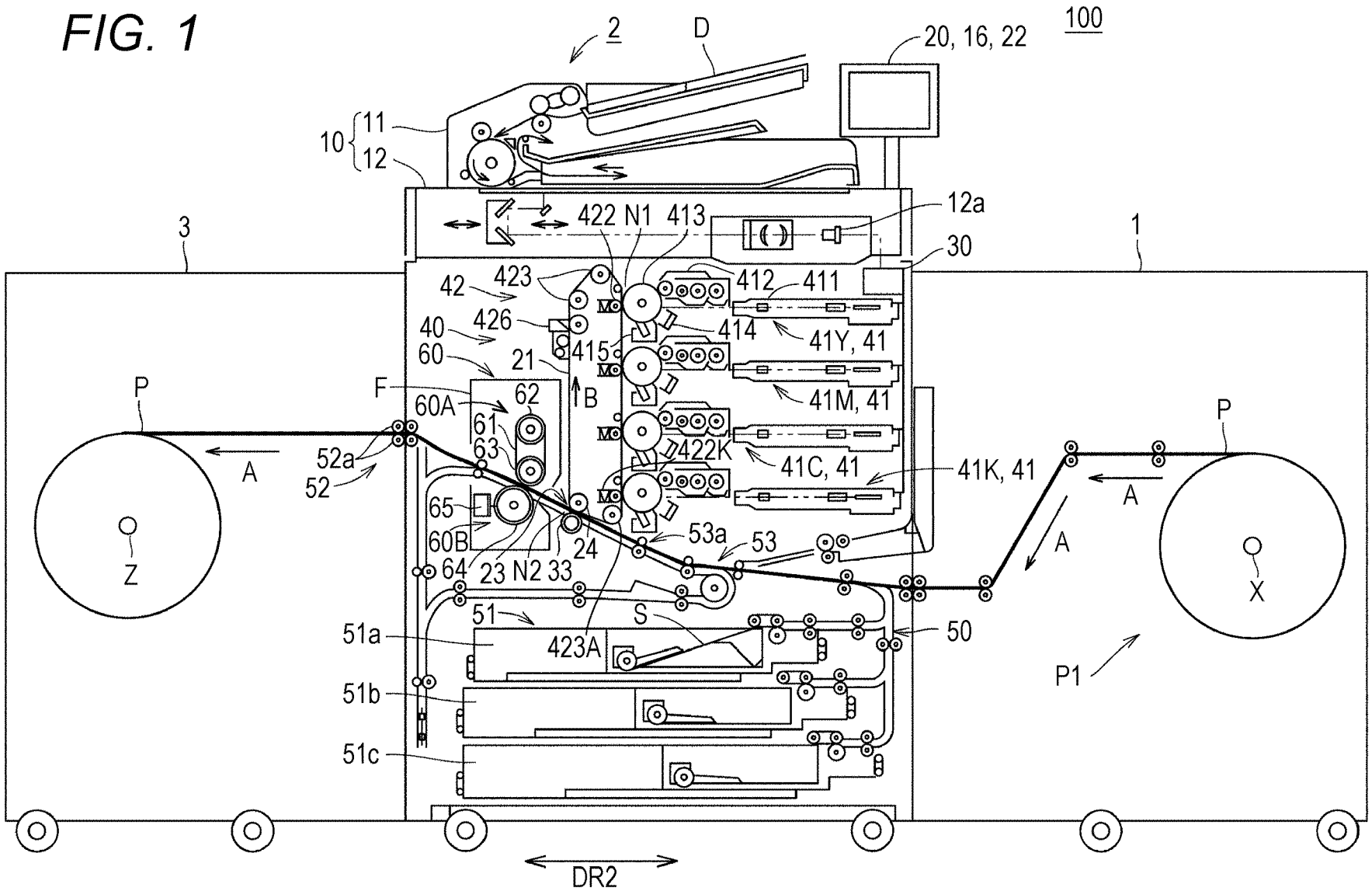
FIG. 1 is a diagram schematically illustrating an entire structure of an image forming system according to a first embodiment.
Figure 2:
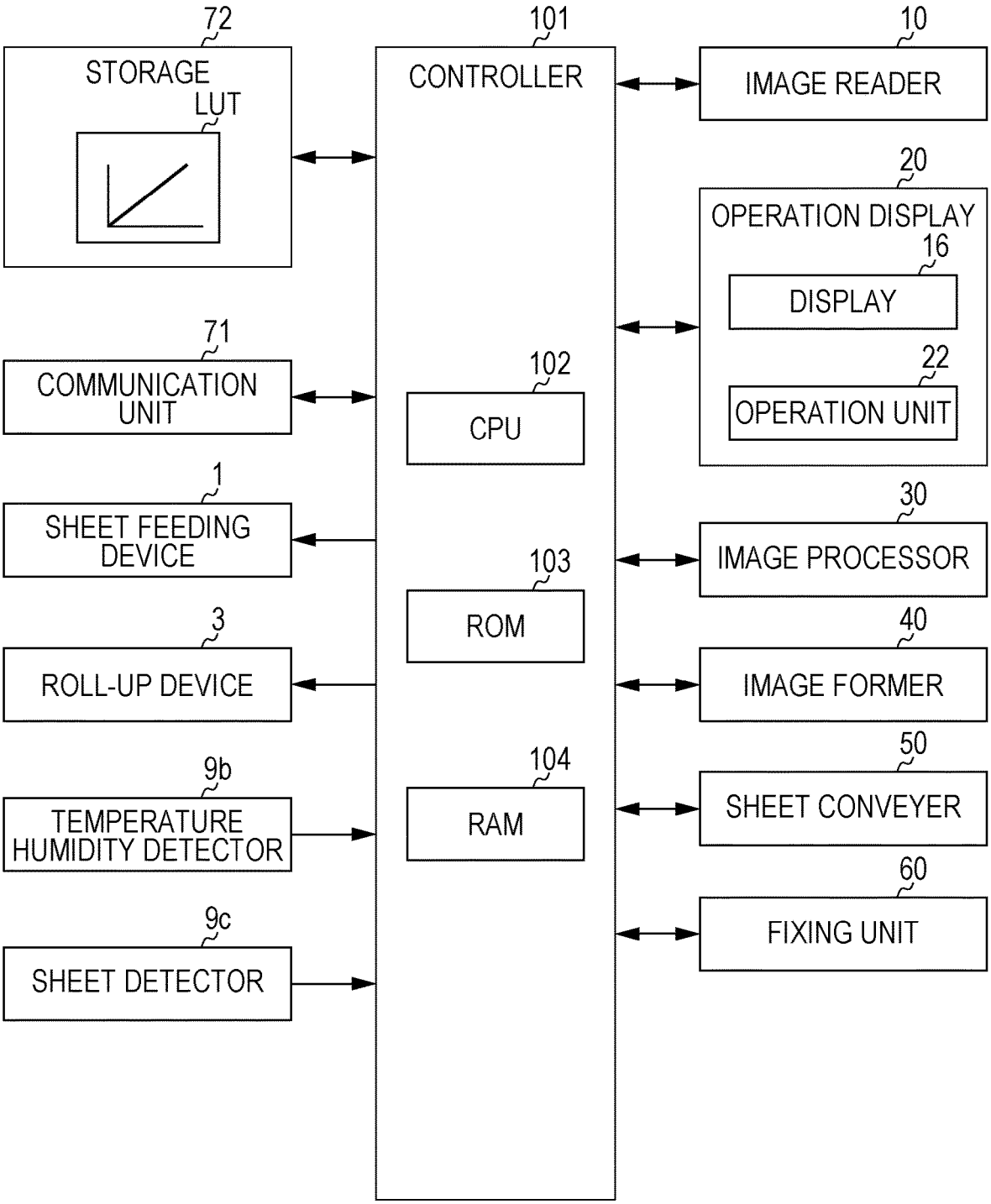
FIG. 2 is a block diagram illustrating a main portion of a control system of an image forming device included in the image forming system of the first embodiment.

FIG. 1 is a diagram schematically illustrating an entire structure of an image forming system 100 according to a first embodiment. FIG. 2 is a block diagram illustrating a main portion of a control system of the image forming device 2 included in the image forming system 100 according to the first embodiment.

The image forming system 100 is a system in which a long sheet P (material is paper or a film) indicated by a bold line in FIG. 1 is used as a recording medium and an image is formed on the long sheet P. The long sheet P is, for example, a sheet having a length exceeding a length in a width direction DR2 of the image forming device 2. The film is, for example, a sheet in which a resin such as polypropylene (PP) or polyethylene terephthalate (PET) is used as a raw material. The "sheet" and "long sheet" in the present specification also include cases where the materials thereof include not only paper but also a plastic resin and the like.

The image forming system 100 is formed by connecting a sheet feeding device 1, the image forming device 2, and a roll-up device 3 from an upstream side in a conveyance path of the long sheet P (in an arrow A direction in FIG. 1). The sheet feeding device 1 feeds the long sheet P to the image forming device 2. The sheet feeding device 1 includes a roll portion P1 inside thereof. In the roll portion P1, the long sheet P is rolled around a support shaft X in a roll shape. The roll portion P1 is rotatable. The sheet feeding device 1 conveys the long sheet P rolled around the support shaft X to the image forming device 2 at a constant speed via, for example, a plurality of pairs of conveyance rollers such as unrolling rollers and sheet feeding rollers. Sheet feeding operation of the sheet feeding device 1 is controlled by a controller 101 included in the image forming device 2.

The image forming device 2 is an intermediate transfer type color image forming device utilizing an electrophotographic process technology. The image forming device 2 primarily transfer, to an intermediate transfer belt 21, each of toner images of Y (yellow), M (magenta), C (cyan), and K (black) formed on respective photosensitive drums 413. The image forming device 2 forms an image by superimposing the toner images of the four colors on the intermediate transfer belt 21 and then performs secondary image transfer to the long sheet P fed from the sheet feeding device 1.

The image forming device 2 adopts a tandem system. In the tandem system, the photosensitive drums 413 corresponding to the four colors of Y, M, C, and K respectively are arranged along a travel direction (arrow B in FIG. 1) of the intermediate transfer belt 21. In the tandem system, the four color toner images of Y, M, C, and K are sequentially transferred onto the intermediate transfer belt 21 in a single procedure.

As illustrated in FIG. 2, the image forming device 2 includes an image reader 10, an operation display 20, an image processor 30, an image former 40, a sheet conveyer 50, a fixing unit 60, a temperature humidity detector 9*b*, a sheet detector 9*c*, and the controller 101.

(Controller 101)

The controller 101 includes a central processing unit (CPU) 102, a read only memory (ROM) 103, a random access memory (RAM) 104, and the like. The CPU 102 reads a program corresponding to processing content from the ROM 103, develops the program in the RAM 104, and performs centralized control for operation of respective blocks in the image forming device 2 in cooperation with the developed program.

At this point, various kinds of data stored in a storage 72 are referred to. The storage 72 includes, for example, a nonvolatile semiconductor memory (so-called flash memory) and a hard disk drive.

The controller 101 exchanges various kinds of data with an external device (such as a personal computer) connected to a communication network such as local area network (LAN) or a wide area network (WAN) via a communication unit 71. The controller 101 receives, for example, image data transmitted from an external device, and forms an image on the long sheet P on the basis of the image data (input image data). The communication unit 71 includes a communication control card such as a LAN card.

(Image Reader 10)

As illustrated in FIG. 1, the image reader 10 includes: an automatic document feeder 11 called an ADF; and a document image scanner 12 (scanner). The automatic document feeder 11 conveys a document D placed on a document tray by a conveyance mechanism and sends the document to the document image scanner 12. With the automatic document feeder 11, it is possible to continuously and collectively read images of a large number of documents D placed on the document tray (including both sheet sides).

The document image scanner 12 optically scans a document conveyed onto a contact glass from the automatic document feeder 11 or a document placed on the contact glass. The document image scanner 12 forms an image of reflected light from the document on a light receiving surface of a charge coupled device (CCD) sensor 12*a*, and reads the document image. The image reader 10 generates input image data on the basis of a read result by the document image scanner 12. The input image data is subjected to predetermined image processing in the image processor 30.

(Operation Display 20)

The operation display 20 is formed of, for example, a liquid crystal display (LCD) attached with a touch panel. The operation display 20 includes a display 16 and an operation unit 22. The display 16 displays various kinds of operation screens, a state of an image, an operation state of each function, a command from the controller 101, and the like in accordance with display control signals received from the controller 101.

The operation unit 22 includes various kinds of operation keys such as a ten-key pad and a start key. The operation unit 22 accepts various kinds of input operation by a user, and outputs operation signals to the controller 101. Information (thickness, material, and the like) on a recording medium to be used can also be input from the operation unit 22.

(Image Processor 30)

The image processor 30 includes a circuit and the like to apply, to input image data, initial setting or digital image processing in accordance with the user setting. For example, the image processor 30 applies gradation correction on the basis of gradation correction data (gradation correction table) under the control of the controller 101.

The image processor 30 applies, to the input image data, not only the gradation correction but also various kinds of correction processing such as color correction and shading correction, and compression processing. The image former 40 is controlled on the basis of image data applied with the above-described processing.

(Image Former 40)

The image former 40 includes image forming units 41Y, 41M, 41C, and 41K, and an intermediate transfer unit 42. The image forming units 41Y, 41M, 41C, and 41K and the intermediate transfer unit 42 form images of toners of respective colors of Y component, M component, C component, and K component on the basis of the input image data.

The image forming units 41Y, 41M, 41C, and 41K each have the similar structure. For convenience of illustration and description, a common constituent element is denoted by the same reference sign, and in a case of differentiating each one of the image forming units, Y, M, C, or K is added to the respective reference signs. In FIG. 1, only the constituent elements of the image forming unit 41Y for the Y component are denoted by reference signs, and the reference signs of the constituent elements of the other image forming units 41M, 41C, 41K are omitted.

An image forming unit 41 includes an exposure device 411, a developing device 412, a photosensitive drum 413, a charging device 414, and a drum cleaning device 415. The photosensitive drum 413 is a negatively charged organic photo-conductor (OPC) having a conductive cylindrical body made of aluminum (aluminum element tube). The photosensitive drum 413 has a drum diameter of, for example, 80 mm. An under coat layer (UCL), a charge generation layer (CGL), and a charge transport layer (CTL) are sequentially layered on an outer peripheral surface of the photosensitive drum 413.

The charge generation layer is an organic semiconductor in which a charge generation material (e.g., phthalocyanine pigment) is dispersed in a resin binder (e.g., polycarbonate). The charge generation layer is exposed by the exposure device 411 to generate a pair of positive electric charge and negative electric charge.

The charge transport layer is formed by dispersing a hole transporting material (electron-releasing nitrogen-containing compound) in a resin binder (e.g., polycarbonate). The charge transport layer transports the positive electric charge generated in the charge generation layer to a surface of the charge transport layer.

A drive motor (not illustrated) rotates the photosensitive drum 413. The controller 101 rotates the photosensitive drum 413 at a constant circumferential speed by controlling driving current of the drive motor.

The charging device 414 uniformly electrically charges a surface of the photosensitive drum 413 to a negative polarity. The exposure device 411 is formed of, for example, a semiconductor laser. The exposure device 411 irradiates the photosensitive drum 413 with laser light corresponding to an image of each color component.

Since the positive electric charge is generated in the charge generation layer of the photosensitive drum 413 and transported to the surface of the charge transport layer, surface electric charge (negative electric charge) of the photosensitive drum 413 is neutralized. An electrostatic latent image of each color component is formed on the surface of the photosensitive drum 413 from a potential difference from the periphery.

The developing device 412 is a developing device of a two-component development type. The developing device 412 makes toner of each color component adhere to the surface of the photosensitive drum 413, thereby visualizing the electrostatic latent image and forming a toner image.

The drum cleaning device 415 has a drum cleaning blade that slidably contacts the surface of the photosensitive drum 413. The drum cleaning device 415 removes the toner that remains on the surface of the photosensitive drum 413 after primary transfer.

The intermediate transfer unit 42 includes the intermediate transfer belt 21, a primary transfer roller 422, a plurality of support rollers 423, a secondary transferrer 23, and a belt cleaning device 426. The intermediate transfer belt 21 is formed endless. The intermediate transfer belt 21 is passed around the plurality of support rollers 423 in a loop shape. At least one of the plurality of support rollers 423 is formed of a driving roller, and other support rollers are formed of driven rollers.

For example, preferably, the roller 423A arranged more on a downstream in the travel direction of the intermediate transfer belt 21 than the primary transfer roller 422K for the K component is a driving roller. With this structure, a travel speed of the intermediate transfer belt 21 is easily kept constant. When the roller 423A is rotated, the intermediate transfer belt 21 travels at the constant speed in the arrow B direction.

The intermediate transfer belt 21 has conductivity. As the intermediate transfer belt 21, it is also possible to use an elastic intermediate transfer belt provided with an elastic layer made of rubber or the like. The intermediate transfer belt 21 includes, on a surface thereof, a high resistance layer having a volume resistivity of 8 to 11 log Ω·cm. The intermediate transfer belt 21 is rotationally driven by a control signal from the controller 101. As for the intermediate transfer belt 21, a material, a thickness, and hardness are not limited as far as conductivity is provided.

The primary transfer roller 422 is arranged on an inner peripheral surface side of the intermediate transfer belt 21. The primary transfer roller 422 is arranged in a manner facing the photosensitive drum 413. The primary transfer roller 422 is pressed against and contacts the photosensitive drum 413 while interposing the intermediate transfer belt 21. With this structure, a primary transfer nip N1 is formed.

When the intermediate transfer belt 21 passes through the primary transfer nip N1, toner images on the respective photosensitive drums 413 are sequentially superimposed and primarily transferred to the intermediate transfer belt 21. Specifically, primary transfer bias is applied to the primary transfer roller 422, and electric charge having a polarity opposite to that of the toner is applied to a rear surface side of the intermediate transfer belt 21 (the side contacting the primary transfer roller 422). With this structure, the toner image is electrostatically transferred to the intermediate transfer belt 21.

The toner image that has been electrostatically transferred onto the intermediate transfer belt 21 is conveyed to a secondary transferrer 23. When the long sheet P passes through the secondary transferrer 23, the toner image on the intermediate transfer belt 21 is secondarily transferred to the long sheet P. Specifically, secondary transfer bias is applied to the secondary transfer roller 33, and provides electric charge having the polarity opposite to that of the toner to a side of the long sheet P contacting the secondary transfer roller 33. Consequently, the toner image is electrostatically transferred to the long sheet P. Details of the secondary transferrer 23 will be described later.

The belt cleaning device 426 contacts an outer peripheral surface of the intermediate transfer belt 21. The belt cleaning device 426 removes toner remaining on the surface of the intermediate transfer belt 21 after secondary transfer.

(Fixing Unit 60)

The long sheet P to which the toner image has been transferred passes through the secondary transferrer 23, and then is conveyed to the fixing unit 60. The fixing unit 60 fixes the toner image on the long sheet P by heating and pressurizing the long sheet P to which the toner image has been secondarily transferred.

The fixing unit 60 includes an upper fixing unit 60A and a lower fixing unit 60B. The upper fixing unit 60A is arranged on a surface (fixing surface) side on which the toner image of the long sheet P is formed. The lower fixing unit 60B is arranged on a side opposite to the fixing surface of the long sheet P. The lower fixing unit 60B is arranged in a manner facing the upper fixing unit 60A. A fixing nip to hold and convey the long sheet P is formed by the lower fixing unit 60B being pressed against and contacting the upper fixing unit 60A.

The fixing unit 60 is arranged as a unit inside a fixing device F. In the fixing device F, an air separation unit that separates the long sheet P from the upper fixing unit 60A or the lower fixing unit 60B by blowing air may also be arranged.

The upper fixing unit 60A includes an endless fixing belt 61, a heating roller 62, and a fixing roller 63 (belt heating system). The fixing belt 61 is passed around the heating roller 62 and the fixing roller 63 with a tension of 40 N, for example.

The fixing belt 61 contacts the long sheet P on which the toner image is formed, and fixes the toner image by performing heating at a fixing temperature of 160 to 200° C. The fixing temperature is a temperature capable of supplying a heat amount necessary to melt the toner on the long sheet P. The fixing temperature is varied by a paper kind and the like of the long sheet P on which an image is to be formed.

The heating roller 62 incorporates a heating source (halogen heater) and heats the fixing belt 61. The temperature of the heating source is controlled by the controller 101. The heating roller 62 is heated by the heating source, and the fixing belt 61 is heated as a result thereof.

Drive control for the fixing roller 63 (e.g., on/off of rotation, adjustment of circumferential speed, and the like) is performed by the controller 101. The controller 101 rotates the fixing roller 63 in a clockwise direction. When the fixing roller 63 is rotated, the fixing belt 61 and the heating roller 62 are driven and rotated in the clockwise direction.

The lower fixing unit 60B has a pressure roller 64 and a press-contacting/separating unit 65 (roller pressing system). The pressure roller 64 includes: a cylindrical core metal made of iron or the like; an elastic layer covering the core metal; and a surface layer covering the elastic layer. The elastic layer is, for example, silicone rubber or the like. The surface layer is, for example, a tetrafluoroethylene-perfluoroalkyl vinyl ether copolymer (PFA) tube.

The press-contacting/separating unit 65 presses the fixing belt 61 and the pressure roller 64 to contact each other or separates these components from each other. The press-contacting/separating unit 65 makes the pressure roller 64 press against and contact the fixing roller 63 via the fixing belt 61 with a fixing load of 1000 N, for example. Thus, a fixing nip to hold and convey the long sheet P is formed between the fixing belt 61 and the pressure roller 64.

Drive control for the pressure roller 64 (e.g., on/off of rotation, adjustment of circumferential speed, and the like) and drive control for the press-contacting/separating unit 65 are performed by the controller 101. The controller 101 rotates the pressure roller 64 in an anticlockwise direction.

(Sheet Conveyer 50)

The sheet conveyer 50 includes a sheet ejection unit 52 and a conveyance path unit 53. The long sheet P fed from the sheet feeding device 1 to the image forming device 2 is conveyed to the secondary transferrer 23 by the conveyance path unit 53. The conveyance path unit 53 has a plurality of pairs of conveyance rollers including a pair of registration rollers 53*a*. The registration roller unit provided with the pair of registration rollers 53*a* corrects inclination and deviation of the long sheet P. After the long sheet P passes through the secondary transferrer 23, the long sheet P is conveyed to the fixing unit 60.

The long sheet P having passed through the fixing unit 60 is conveyed to the sheet ejection unit 52. The sheet ejection unit 52 has a pair of conveyance rollers 52*a* (pair of ejection rollers). The long sheet P on which an image has been formed is conveyed to the roll-up device 3 via the pair of conveyance rollers 52*a*.

The roll-up device 3 is a device that rolls up the long sheet P conveyed from the image forming device 2. In a housing of the roll-up device 3, the long sheet P is rolled around a support shaft Z and held in a roll shape, for example. Accordingly, the roll-up device 3 rolls up, around the support shaft Z, the long sheet P conveyed from the image forming device 2 via the plurality of pairs of conveyance rollers (e.g., unrolling rollers and sheet ejection rollers) at a constant speed. Such roll-up operation of the roll-up device 3 is controlled by the controller 101.

The sheet conveyer 50 further includes a sheet feeder 51. The sheet feeder 51 includes sheet feed tray units 51*a*, 51*b*, and 51*c*. A sheet S identified on the basis of a basis weight, a size, and the like is stored in each of the sheet feed tray units 51*a*, 51*b*, and 51*c* per preset kind (standard paper and special paper). In the image forming device 2 of the first embodiment, a sheet S can be used instead of the long sheet P.

The sheets S stored in the sheet feed tray units 51*a*, 51*b*, and 51*c* are sent out one by one from an uppermost portion and then conveyed to the secondary transferrer 23 by the conveyance path unit 53. In the secondary transferrer 23, toner images on the intermediate transfer belt 21 are secondarily and collectively transferred to one side of the sheet S, an fixing processing is applied in the fixing unit 60.

(Temperature Humidity Detector 9*b*)

The temperature humidity detector 9*b* illustrated in FIG. 2 detects a temperature and humidity inside or in the periphery of the image forming device 2. The temperature humidity detector 9*b* transmits detection results to the controller 101. The controller 101 controls a setting temperature and the like of the heater in accordance with the detection results of the temperature humidity detector 9*b*. The temperature humidity detector 9*b* is adapted not to detect: a temperature in the periphery of a device, such as the fixing unit 60, having possibility to become a high temperature due to the structure of the image forming device 2; and a temperature of an exhaust air of the image forming device 2.

(Sheet Detector 9*c*)

The sheet detector 9*c* detects information on a recording medium. The information on a recording medium is, for example, a thickness, a material, capacitance, a moisture content, and the like of a recording medium. The sheet detector 9*c* can obtain thickness information on the recording medium by detecting a distance between axes of the pair of rollers on the conveyance path.

The sheet detector 9*c* includes a light emitting element and a light receiving element facing each other while interposing a recording medium. The light receiving element receives light having passed through the recording medium out of light emitted from the light emitting element. The sheet detector 9*c* can obtain information on a material of a recording medium by detecting a transmittance of the light emitted from the light emitting element. The materials of a recording medium include plain paper, coated paper, polyethylene terephthalate (PET), polypropylene (PP), or the like.

The sheet detector 9*c* can obtain capacitance information on a recording medium from electric current or a voltage signal obtained by applying AC bias in a state where the recording medium is interposed between the pair of electrodes on the conveyance path.

As the sheet detector 9*c*, not limited to an electric sensor or an optical sensor described above, it is also possible to use other types of sensors that can identify a thickness, a material, capacitance, a moisture content, and the like of a recording medium.

(Secondary Transferrer 23)

Figure 3:
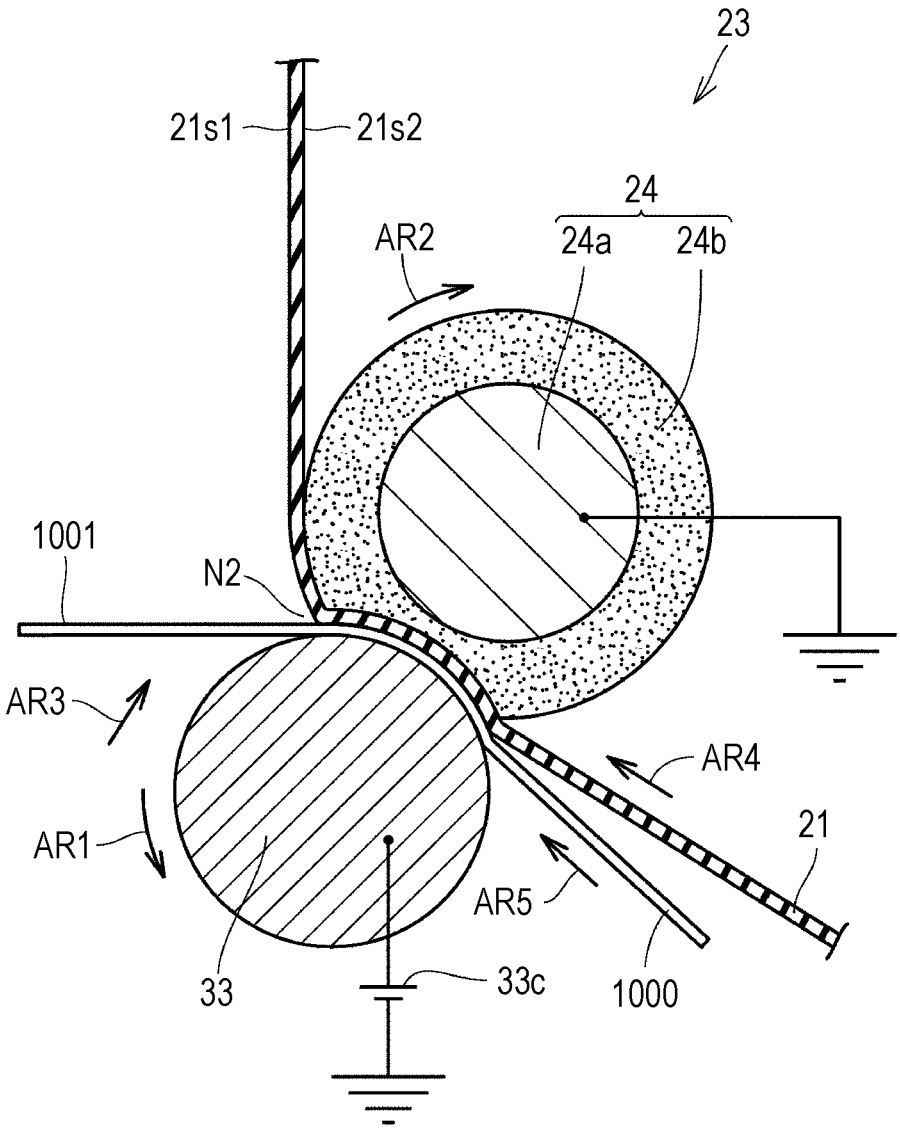
FIG. 3 is an enlarged view of a secondary transferrer illustrated in FIG. 1.

FIG. 3 is an enlarged view of the secondary transferrer 23 illustrated in FIG. 1. The secondary transferrer 23 includes the secondary transfer roller 33 and a counter roller 24. The secondary transfer roller 33 is made of a conductive material. A secondary transfer power source 33*c* is connected to the secondary transfer roller 33. The secondary transfer roller 33 is rotationally driven in an arrow AR1 direction illustrated in FIG. 3. The secondary transfer roller 33 is pressed by a pressing mechanism (not illustrated) in an arrow AR3 direction illustrated in FIG. 3 at the time of the secondary transfer.

The secondary transfer roller 33 is pressed against and contacts the counter roller 24 via a recording medium 1000 and the intermediate transfer belt 21. Consequently, a secondary transfer nip N2 is formed in order to transfer toner images on the intermediate transfer belt 21 to the long sheet P. The secondary transfer nip N2 is a contact portion between the secondary transfer roller 33 and the counter roller 24.

The counter roller 24 is arranged on the inner peripheral surface side of the intermediate transfer belt 21. The counter roller 24 faces the secondary transfer roller 33. The counter roller 24 is rotationally driven in an arrow AR2 direction illustrated in FIG. 3. The counter roller 24 includes: a core metal 24*a* made of a conductive material; and a conductive elastic portion 24*b* covering a peripheral surface of the core metal 24*a*. The core metal 24*a* is grounded. With this structure, a predetermined electric field is formed at the secondary transfer nip N2 by the secondary transfer roller 33, counter roller 24, and secondary transfer power source 33*c*.

The intermediate transfer belt 21 is arranged in a manner inserted through the secondary transfer nip N2. The intermediate transfer belt 21 is arranged in a manner inserted through more on the counter roller 24 side than the recording medium 1000 is. The recording medium 1000 is fed so as to pass through the secondary transfer nip N2. The recording medium 1000 is fed so as to pass through more on the secondary transfer roller 33 side than the intermediate transfer belt 21 is.

The intermediate transfer belt 21 is conveyed in an arrow AR4 direction by rotation of the secondary transfer roller 33 and the counter roller 24. The recording medium 1000 is conveyed in an arrow AR5 direction. The intermediate transfer belt 21 and the recording medium 1000 are interposed between the secondary transfer roller 33 and the counter roller 24 in a state pressed by these rollers, and closely contact each other at the time of passing through the secondary transfer nip N2.

The above-described predetermined electric field acts on the closely contacting portion of the intermediate transfer belt 21 and the recording medium 1000. Consequently, a toner image having adhered to a first main surface 21*s*1 of the intermediate transfer belt 21 adheres to a recording surface 1001 of the recording medium 1000, thereby transferring the toner image.

<General Problem Generated in Case of Using Recording Medium Having Large Thickness>

Generally, the larger a thickness of a recording medium is, the higher an electric resistance of the recording medium is. In a case of performing electrostatic transfer to a high-resistance recording medium, higher applied voltage is required between the transfer roller and the counter roller in order to cause a sufficient transfer electric field to act on a toner image.

In the case of applying high voltage, electric discharge tends to occur before and after the secondary transfer nip or in the secondary transfer nip. In the event of such electric discharge, an electric charge quantity to the toner is changed. A toner particle in which a charged electric charge quantity has been changed is hardly moved by an electric field, and transfer efficiency is degraded.

In the event of electric discharge, it is preferable to extend a nip time N (value obtained by dividing a length w of the secondary transfer nip in the conveyance direction of a recording medium by a system speed $V_{sys}$), instead of increasing applied voltage. Here, the "system speed" represents a travel speed in each of a photosensitive drum of each color, the intermediate transfer belt, and the like, and a printing speed (the number of printed sheets per unit time) is controlled by controlling the system speed.

When the nip time is extended, more current flows even with the same applied voltage. Since a larger amount of current flows, more electric charge is accumulated on a surface of a recording medium, the surface of the intermediate transfer belt, and the like. Since more electric charge is accumulated, it is possible to form an electric field that can sufficiently transfer a toner image. Transfer can be performed with high transfer efficiency by extending the nip time even without increasing the applied voltage.

In a case of forming an image on a recording medium having a large thickness, the applied voltage is increased to secure transfer efficiency. However, in a case where the applied voltage cannot be increased any further due to occurrence of electric discharge, transfer efficiency can be secured by extending the nip time.

Conventionally, there may be a case of using an OHP sheet. The OHP sheet is a transparent film used to perform projection with a projector. The OHP sheet has a thickness of about 100 μm that is thicker than that of plain paper (about 80 μm). For this reason, the OHP sheet is also handled by increasing the applied voltage, extending the nip time, of the like in a manner similar to the thick paper.

<Problems Generated in Case of Using Recording Medium Having Small Thickness and Causes Thereof>

(In Case of Using Film Having Small Thickness)

In a case of forming an image on a recording medium having a small thickness (thickness of 50 μm or less, particularly 25 μm or less), especially on a film, a situation has occurred in which transfer could not be sufficiently performed even by adjusting applied voltage. As a result of study, it is confirmed that capacitance of a recording medium becomes excessively large in the case of using a film having a small thickness, and therefore, electric charge necessary to perform transfer cannot be accumulated fast, and transfer cannot be performed within a nip time. Following experiments were executed in order to clarify a reason why transfer could not be sufficiently performed even though the applied voltage was adjusted in the case of using the film having the small thickness.

Figure 4:
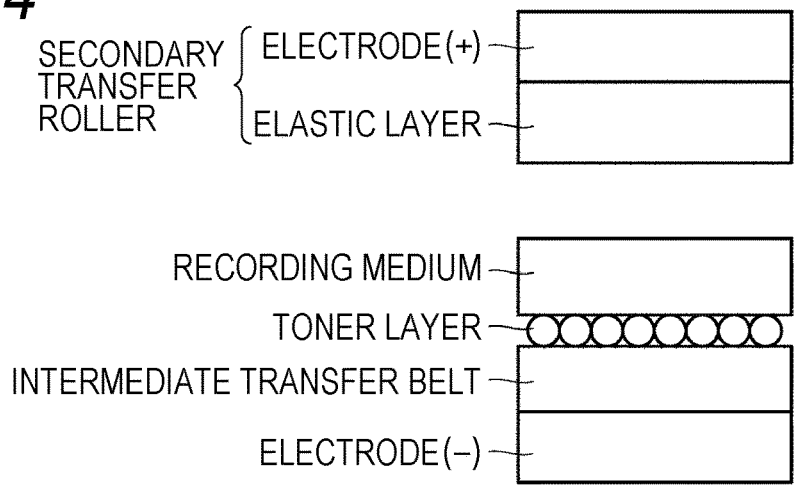
FIG. 4 is a schematic diagram in which the secondary transferrer is reproduced by a parallel plate structure.

FIG. 4 is a schematic diagram in which the secondary transferrer 23 is reproduced by a parallel plate structure. The secondary transferrer 23 was reproduced by sequentially arranging an electrode (−), an intermediate transfer belt, a toner layer, a film (recording medium), an elastic layer, and an electrode (+) from a lower side of FIG. 4. The secondary transfer roller was reproduced as the elastic layer and the electrode (+). In the electrode (+), the sheet-like elastic layer was preliminarily bonded to a lower side of the electrode (+).

Figure 5:
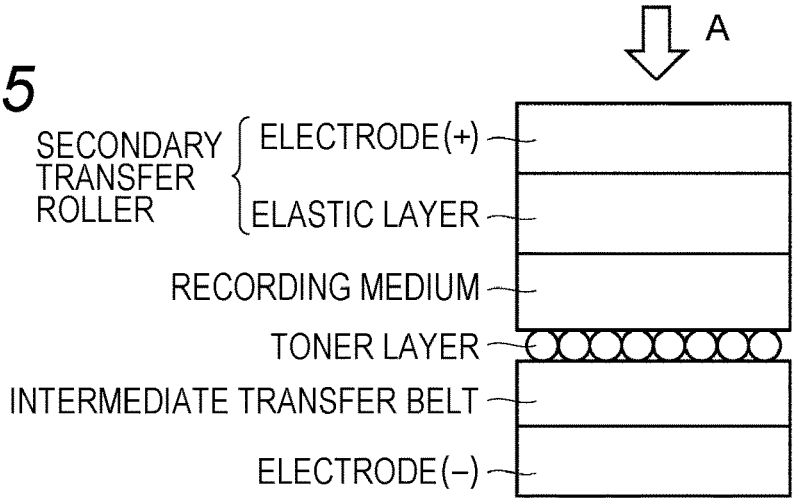
FIG. 5 is a schematic diagram illustrating a state in which a secondary transfer roller is pressed against a recording medium.

FIG. 5 is a schematic diagram illustrating a state in which the secondary transfer roller 33 is pressed against the recording medium 1000. The state in which the electrode (+) and the electrode (−) were pressed against and contacted each other via the intermediate transfer belt, toner layer, film and secondary transferrer was reproduced by moving the electrode (+) downward (in an arrow A direction in FIG. 5).

Figure 6:
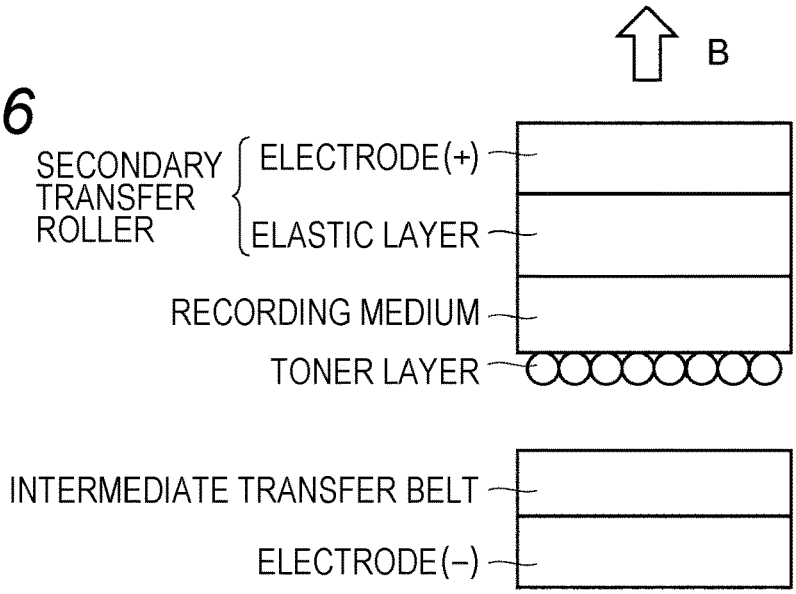
FIG. 6 is a schematic diagram illustrating a state in which the secondary transfer roller is pressed against the recording medium and then the pressed state is released.

FIG. 6 is a schematic diagram illustrating a state in which the secondary transfer roller 33 is pressed against the recording medium 1000 and then the pressed state is released. When the electrode (+) was moved upward (in an arrow B direction in FIG. 6), the recording medium was moved upward in a state contacting the secondary transfer roller.

When voltage was applied between the electrode (+) and the electrode (−) in a direction attracting the electrically charged toner toward the recording medium while both electrodes (electrode (+) and electrode (−), same in the following) (FIG. 5) were pressed against and contacted each other, the toner layer was transferred in accordance with the applied voltage. In the parallel flat plates illustrated in FIGS. 4 to 6, examination was made on a relation between the applied voltage and transfer efficiency to respective films having various thicknesses. Evaluation conditions are provided in the following.

(Evaluation Conditions)

As a secondary transfer roller, a roller having a diameter of 40 mm was assumed. A core metal of the secondary transfer roller was assumed to have a diameter of 24 mm. An elastic layer made of rubber was provided around the metal core. The elastic layer had a thickness of 8 mm. The elastic layer had hardness of 40 degrees. The elastic layer had a volume resistivity of about $1\times10^8$ Ω·cm.

A material of the intermediate transfer belt was polyimide. The intermediate transfer belt had a thickness of 80 μm. The intermediate transfer belt had a volume resistivity of about $1\times10^9$ Ω·cm. A material of the recording medium was PET. A toner amount was 4.5 g/m$^2$. Transfer efficiency was calculated from a ratio of the weight of the toner layer on the intermediate belt before transfer and the weight of the toner layer that was transferred to the film after press-contacting and separation of both electrodes.

Figure 7:
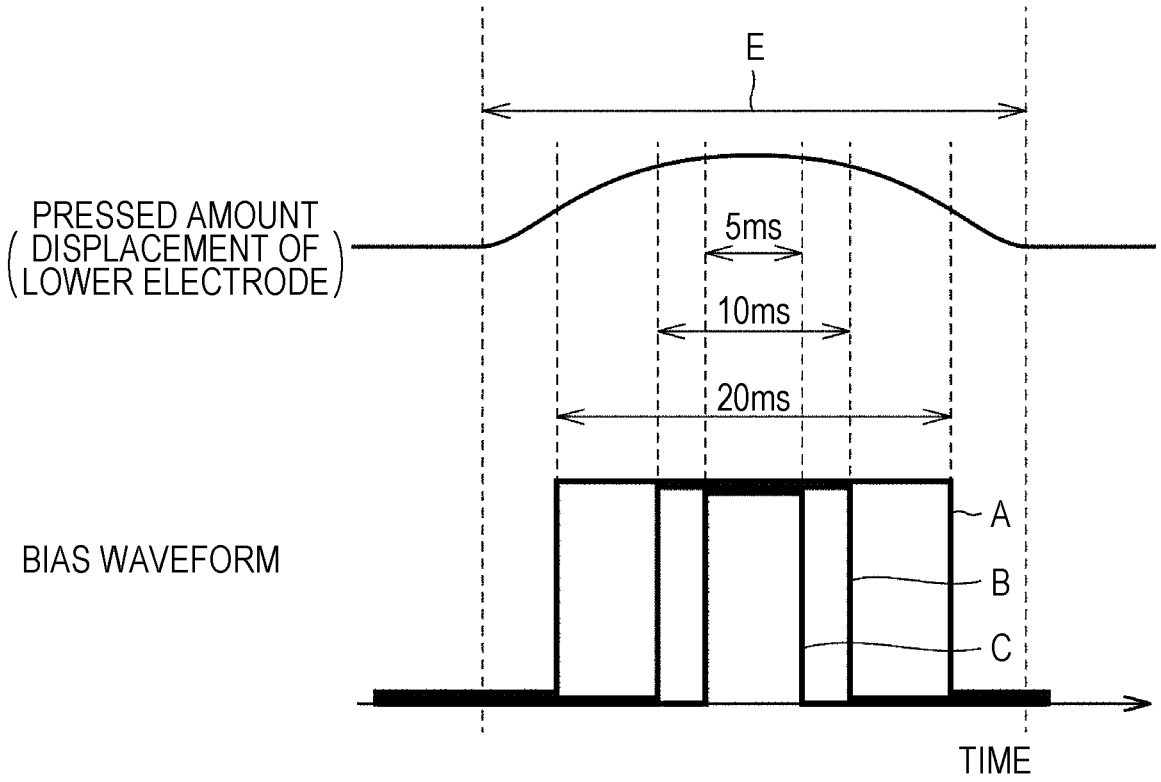
FIG. 7 is a view illustrating an image including a pressed amount waveform and a bias application waveform between both electrodes while both electrodes contact each other in a manner pressed against each other.

FIG. 7 is a view illustrating an image including a pressed amount waveform and a bias application waveform between both electrodes while both electrodes are pressed against and contact each other. A period during which the pressed amount was changed from an initial value (region E in FIG. 7) corresponds to a period during which both electrodes were being pressed and contacted each other.

FIG. 7 illustrates images of the respective waveforms in cases of setting a bias application period to 20 ms (A waveform), 10 ms (B waveform), and 5 ms (C waveform) while both electrodes are pressed against and contact each other. First, an evaluation test was performed for each of films respectively having the thicknesses of 75 μm, 50 μm, 25 μm, and 10 μm by setting the bias application period to 5 ms (C waveform).

(Evaluation Results)

Figure 8:
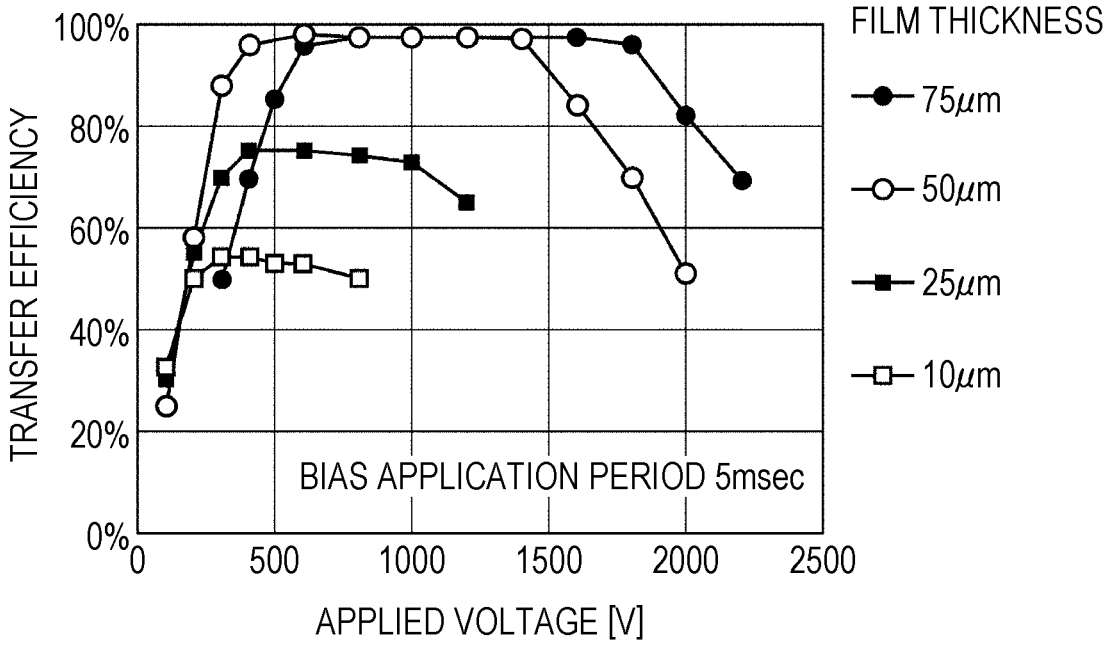
FIG. 8 is a graph illustrating a relation between transfer efficiency and applied voltage between both electrodes for films respectively having thicknesses of 75 μm, 50 μm, 25 μm, and 10 μm.

FIG. 8 is a graph illustrating a relation between transfer efficiency and applied voltage between both electrodes for the films respectively having the thicknesses of 75 μm, 50 μm, 25 μm, and 10 μm. In the case of the film having the thickness of 75 μm, transfer efficiency close to 100% could be obtained when the applied voltage was between about 600 V and 1800 V. On the other hand, when the applied voltage exceeded about 1800 V, electric discharge was likely to occur and transfer efficiency was degraded. It was found that good transferability could be secured by appropriately setting the applied voltage.

In the case of the film having the thickness of 50 μm, the maximum applied voltage to obtain transfer efficiency close to 100% was about 1400 V. The maximum applied voltage at which transfer efficiency close to 100 [%] could be obtained was smaller than that in the case where the thickness was 75 μm. When the applied voltage exceeded about 1400 V, electric discharge was likely to occur and the transfer efficiency was degraded.

Furthermore, in the film having the thickness of 25 μm, transfer efficiency was 80% or less even at a peak value, and good transferability could not be secured even though the applied voltage was adjusted. In the film having the thickness of 10 μm, transfer efficiency was degraded to 60% or less even at a peak value. Here, examination was made on the relation between the applied voltage and the transfer efficiency by changing the bias application period while using the film having the thickness of 10 μm.

Figure 9:
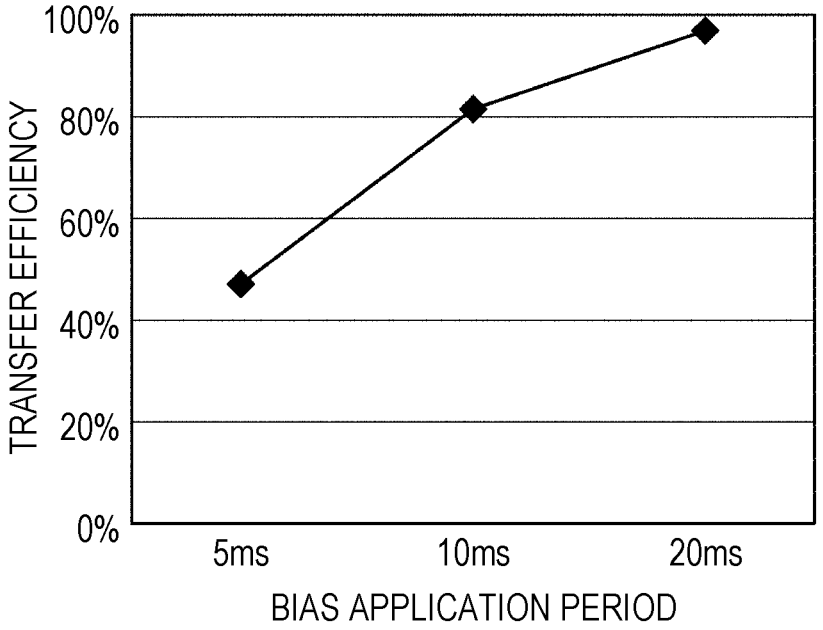
FIG. 9 is a graph illustrating a relation between a bias application period and transfer efficiency in a case of using the film having the thickness of 10 μm.

FIG. 9 is a graph illustrating a relation between the bias application period and the transfer efficiency in the case of using the film having the thickness of 10 μm. A horizontal axis of FIG. 9 represents the bias application period between both electrodes. A vertical axis of FIG. 9 represents the transfer efficiency of the film. The transfer efficiency exhibited a peak value. The longer the bias application period was, the higher the transfer efficiency was. Therefore, even in the case of using the film having the thickness of 10 μm, good transferability could be secured by appropriately setting the applied voltage and by setting the bias application period to 20 ms.

Regarding the reason why transfer could not be sufficiently performed even though the applied voltage was adjusted in the case of forming an image on a film having a small thickness, the following reason can be considered.

Figure 10:
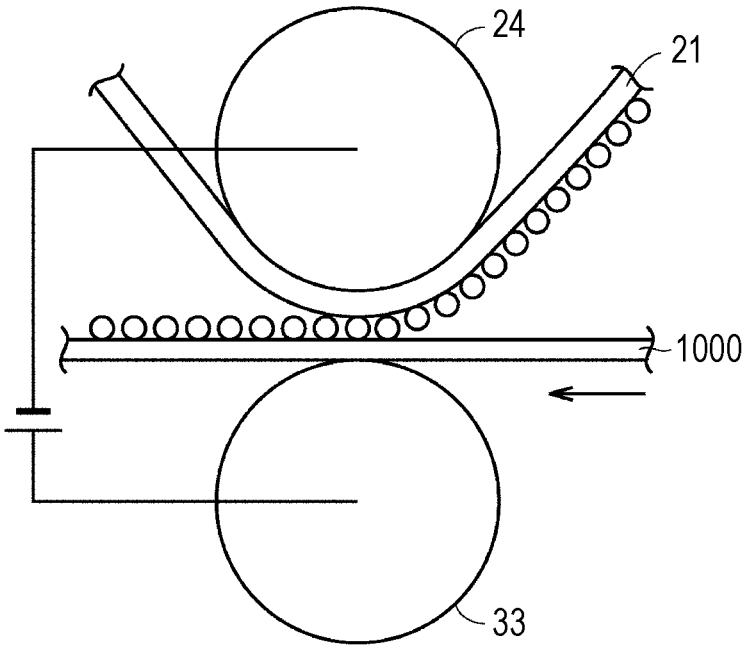
FIG. 10 is a diagram simply illustrating a structure of the secondary transferrer.

FIG. 10 is a diagram simply illustrating a structure of the secondary transferrer. In a case of using a film made of PET or the like as a recording medium, the recording medium has an extremely high resistance, and therefore, the recording medium can be deemed as a substantially insulator. Therefore, the film is considered similar to a capacitor, and a secondary transferrer can be deemed as an equivalent circuit including the capacitor.

It is assumed that capacitance of the capacitor corresponding to the film is $C_{med}$ F/m$^2$. Similarly, since a toner layer also functions as an insulator, the toner can be considered similar to a capacitor. It is assumed that capacitance of the capacitor corresponding to the toner layer is $C_{toner}$ F/m$^2$. Since the secondary transfer roller, intermediate transfer belt, and counter roller are semiconductive resistors, resistances thereof are assumed as R1 [Ω·m$^2$], R2 [Ω·m$^2$], and R3 [Ω·m$^2$] respectively. The secondary transferrer can be deemed as the equivalent circuit including the resistance R1 of the secondary transfer roller, the resistance R2 of the intermediate transfer belt, the resistance R3 of the counter roller, the capacitance $C_{med}$ of the recording medium, and the capacitance of toner $C_{toner}$.

Figure 11:
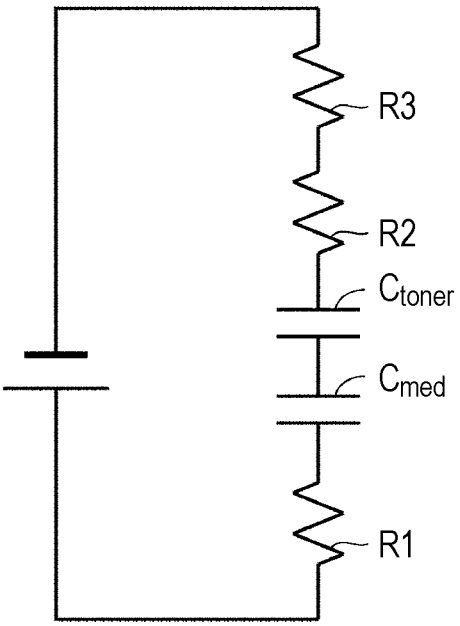
FIG. 11 is an equivalent circuit diagram of the secondary transferrer.

FIG. 11 is an equivalent circuit diagram of the secondary transferrer. At this point, an electric charge quantity q(t) accumulated in the equivalent circuit can be expressed by Expression (1) below.

$$q(t)=CV(1-\exp(-t/RC)) \quad (1)$$

Here, C represents combined capacitance $C_{total}$ in the equivalent circuit and also is $C_{total}=(C_{toner}\times C_{med})/(C_{toner}+C_{med})$ in the first embodiment. R represents a combined resistance $R_{total}$ in the equivalent circuit and is $R_{total}$=R1+R2+R3 in the first embodiment. V represents applied voltage. A toner amount that can be transferred is determined in accordance with an electric charge quantity q accumulated in the equivalent circuit.

In the equivalent circuit, it is necessary to accumulate the electric charge quantity substantially equal to an electric charge quantity of a charged toner layer in order to transfer toner of nearly 100%. In a case where the accumulated electric charge quantity q is smaller than the electric charge quantity of the charged toner layer, only a part of the toner layer can be transferred, in other words, good transfer efficiency cannot be obtained.

In Expression (1), in a case where a nip time is sufficiently long, the electric charge quantity q at the time of setting t to infinite ($t\rightarrow\infty$) is accumulated, and therefore, the accumulated electric charge quantity becomes $q(t\rightarrow\infty)=CV$. In the case where the capacitance $C_{med}$ of the recording medium is large, the combined capacitance $C_{total}$ in the circuit also becomes large, and therefore, the applied voltage V needed to accumulate the same electric charge quantity q is reduced. Therefore, in the case where the nip time is sufficiently long, the larger capacitance of a recording medium is, the more reduced the required applied voltage is.

However, the nip time is actually finite. In a case where the nip time is short, there may be a case where an electric charge quantity q cannot be sufficiently accumulated in the nip In Expression (1), a time constant τ (=combined resistance $R_{total}\times$combined capacitance $C_{total}$) is a parameter representing an accumulation speed of the electric charge. In a case where the time constant τ is small, electric charge is accumulated fast relative to increase in a time t. In a case where the time constant τ is large, electric charge is accumulated slowly relative to increase in the time t. Since the combined capacitance $C_{total}$ of the circuit also becomes large in the case where the capacitance $C_{med}$ of the recording medium is large, the time constant τ also becomes large.

Therefore, in the case where the capacitance $C_{med}$ of the recording medium is large, electric charge is slowly accumulated relative to the increase in the time t. As a result, in the case where the capacitance $C_{med}$ of the recording medium is large, there may be a risk that the electric charge quantity q cannot be accumulated in the nip depending on the nip time.

Figure 12:
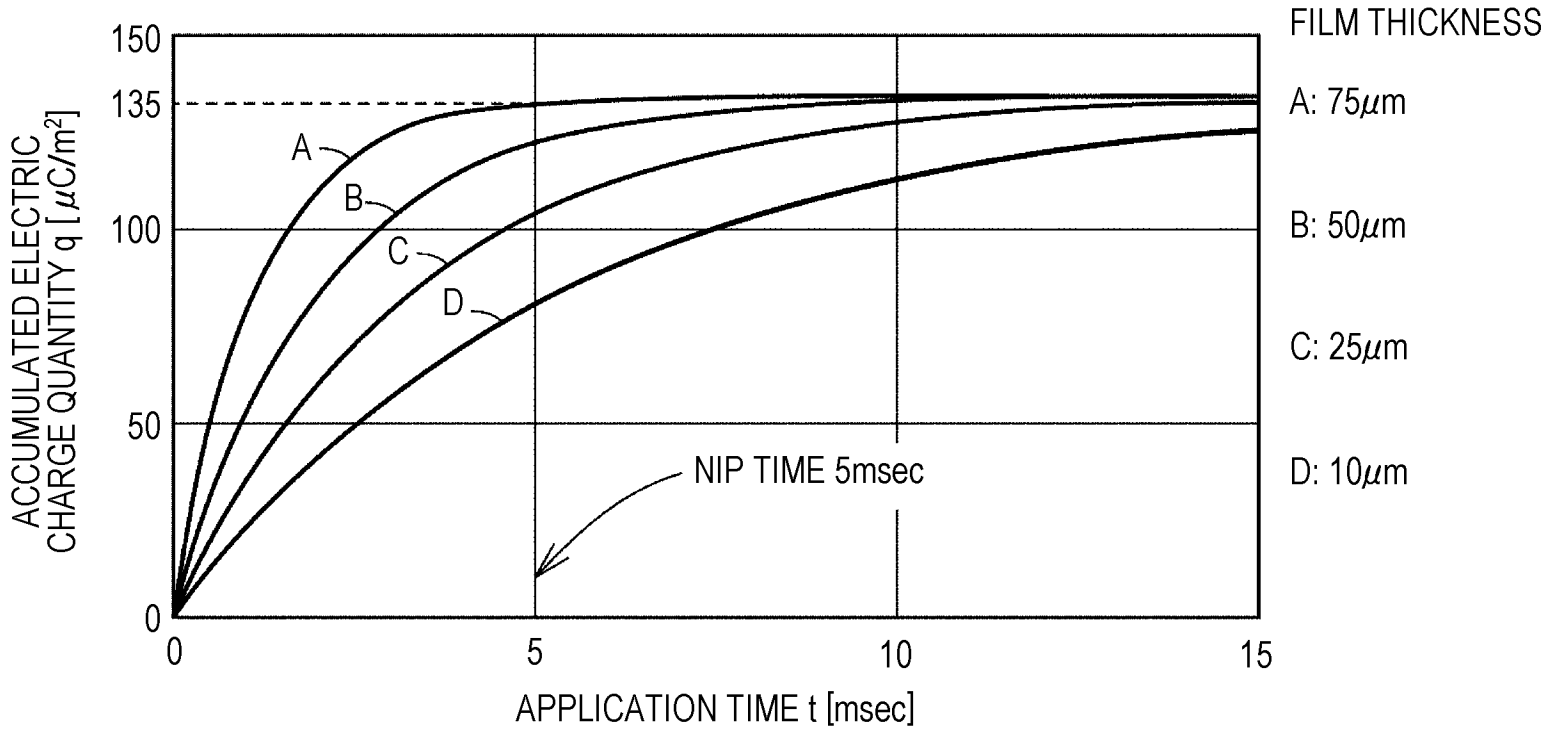
FIG. 12 is a graph in which an electric charge quantity accumulated in the equivalent circuit is calculated.

FIG. 12 is a graph in which the electric charge quantity accumulated in the equivalent circuit is calculated. A horizontal axis of FIG. 12 represents the bias application period. A vertical axis of FIG. 12 represents the electric charge quantity accumulated in the circuit. Calculations are executed using physical property values of the secondary transfer roller, the intermediate transfer belt, the counter roller, the recording medium, and the toner included in the equivalent circuit of the secondary transferrer.

In the case where a nip width (length of the secondary transfer nip N2 in the conveyance direction of a recording medium) is 3 mm and a system speed is 600 mm/sec, the nip time becomes 5 msec. In the case where an electric charge quantity per unit area of the toner on the intermediate transfer belt was 135 μC/m$^2$, it can be grasped that electric charge needed to transfer, to a film having a thickness of 75 μm, almost all of the toner can be accumulated within a nip time (within 5 msec) (graph A). However, as the thickness of the film is gradually reduced to 50 μm (graph B), 25 μm (graph C), and 10 μm (graph D), the electric charge quantity that can be accumulated within the nip time is gradually reduced, and all of the toner cannot be transferred.

Regarding such a problem, it can also be presumed from Expression (1) that the electric charge quantity q can be increased by increasing the applied voltage V. However, this method is not a sufficient solution. The reason will be described below. In the equivalent circuit of FIG. 11, in a case where voltage distributed to the toner layer is defined as Vt, Vt is expressed by Expression (2) below.

$$Vt=C_{med}/(C_{toner}+C_{med})\times V \quad (2)$$

According to Expression (2), it can be grasped that the larger capacitance $C_{med}$ of the recording medium is, the larger the voltage Vt is distributed to the toner layer out of the applied voltage V. When the voltage Vt distributed to the toner layer becomes excessively large, electric discharge is likely to occur between the intermediate transfer belt and the surface of the recording medium via the toner layer. In the event of electric discharge, the electric charge quantity of the toner is changed, and transfer efficiency is degraded.

Due to the above-described reason, in the case where the capacitance of the recording medium is excessively large, the electric charge needed to transfer the toner cannot be obtained by small applied voltage. On the other hand, electric discharge occurs in the case of large applied voltage, and therefore, sufficient transfer efficiency cannot be obtained by any applied voltage. Thus, when the capacitance of the recording medium is excessively large, sufficient transfer efficiency cannot be obtained even though the applied voltage is adjusted.

As it can be grasped from Expression (1), to increase the accumulated electric charge quantity without increasing the applied voltage V, the nip time is to be extended or the time constant τ ($=R_{total}\times C_{total}$) is to be reduced. By adjusting at least one of the nip time and the time constant in accordance with capacitance of a recording medium on which an image is to be formed, it is possible to secure transfer efficiency even in the case where the recording medium has a small thickness (including a film and a long sheet).

The controller 101 adjusts at least one of the nip time and the time constant in accordance with capacitance of a recording medium acquired by the sheet detector 9*c*. In the case where the capacitance of the recording medium is large, the controller 101 performs adjustment such that the nip time is extended. In the case where the capacitance of the recording medium is large, the controller 101 performs adjustment such that the time constant is reduced. With this adjustment, transfer efficiency can be secured for various kinds of recording media.

(In Case of Using Recording Medium Other than Film Having Small Thickness)

In a case of using not a film but a recording medium having a high resistance, there may be a problem in which sufficient transfer efficiency cannot be obtained even though the applied voltage is adjusted, similar to the case of using a film. The reason is that: when the recording medium has the high resistance, the recording medium can be considered as a capacitor in a manner similar to the case of the film that functions as an insulator.

For example, in a case where water content in a recording medium is little in an environment having a low temperature and low humidity, a resistance value of a recording medium becomes high. Additionally, when a recording medium passes through the fixing unit 60, the water content contained in the recording medium is reduced as a result of the process in which the recording medium is heated and moisture contained in the recording medium is evaporated. Therefore, in the case of printing a second side in double face printing, a resistance of a recording medium may become high.

In the case where the resistance of the recording medium becomes high, transfer conditions are needed to be changed in accordance with capacitance, similar to the case of a film. In other words, similar to the case of a film, the controller 101 adjusts at least one of the nip time N and the time constant $\tau$ in accordance with capacitance of a recording medium acquired by the sheet detector 9*c*. With this adjustment, high transfer efficiency can be stably secured for various kinds of recording media (having different print conditions such as a thickness, a material, water content, and double face printing).

When the system speed is defined as $V_{sys}$ [mm/sec] and the nip width of the secondary transferrer is defined as w [mm], the nip time N [sec] is expressed by Expression (3) below.

$$N=w/V_{sys} \tag{3}$$

In the image forming device 2 according to the first embodiment, the controller 101 adjusts the nip time N in accordance with capacitance of a recording medium acquired by the sheet detector 9*c*. The controller 101 adjusts the nip time N by changing the system speed. The larger the capacitance of the recording medium acquired by the sheet detector 9*c* is, the more the controller 101 extends the nip time N, in other words, the more the controller 101 reduces the system speed.

With this adjustment, transfer efficiency can be secured for various kinds of recording media. Since the nip time is adjusted by changing the system speed, it is not necessary to add a new configuration, and a manufacturing cost can be suppressed.

Second Embodiment

Figure 13:
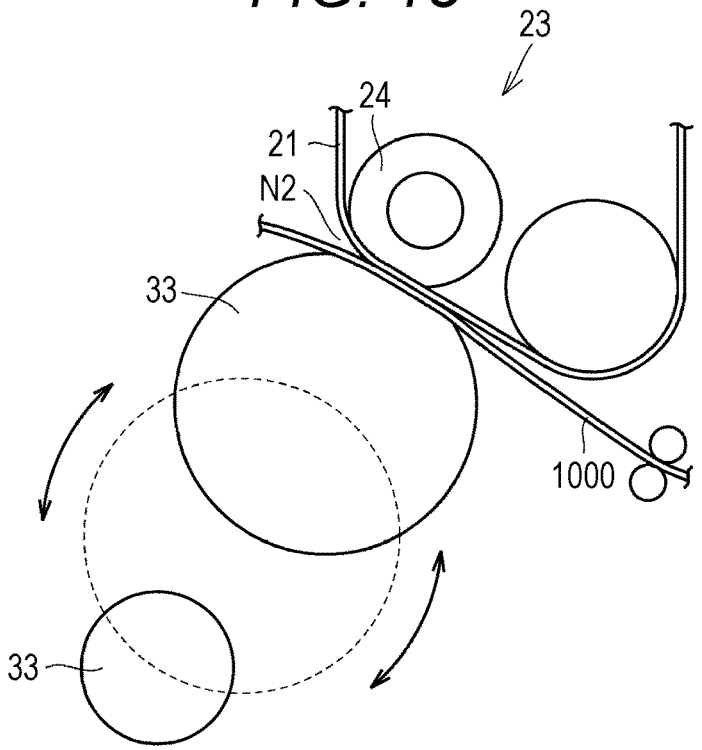
FIG. 13 is a schematic diagram of a secondary transferrer according to a second embodiment.

FIG. 13 is a schematic diagram of a secondary transferrer 23 according to the second embodiment. The secondary transferrer 23 includes a plurality of secondary transfer rollers 33 having different outer diameters. A nip width w can be changed and a nip time N can be changed by switching a secondary transfer rollers 33 among the plurality thereof.

The larger an outer diameter of the secondary transfer roller 33 is, the longer the nip width w is. In a case where capacitance of a recording medium 1000 is large, the nip time N may be extended by performing switching to a secondary transfer roller 33 having a large diameter.

A controller 101 selects, from among the plurality of secondary transfer rollers 33 having the different outer diameters, a secondary transfer roller 33 corresponding to the capacitance of the recording medium 1000 acquired by a sheet detector 9*c*, and adjusts the nip time N by switching a currently-used secondary transfer roller 33 to the selected one. The secondary transfer roller 33 corresponding to the capacitance of the recording medium 1000 is the secondary transfer roller 33 capable of securing a nip time during which high transfer efficiency can be achieved in a case of performing printing on the recording medium 1000 (the same is applied to a secondary transfer roller 33 corresponding to capacitance of any recording medium 1000 in the following).

With this adjustment, transfer efficiency can be secured for various kinds of recording media 1000. Furthermore, since the nip time N is adjusted without changing a conveyance speed (system speed) of the recording medium, productivity can be prevented from being degraded.

Third Embodiment

Figure 14:
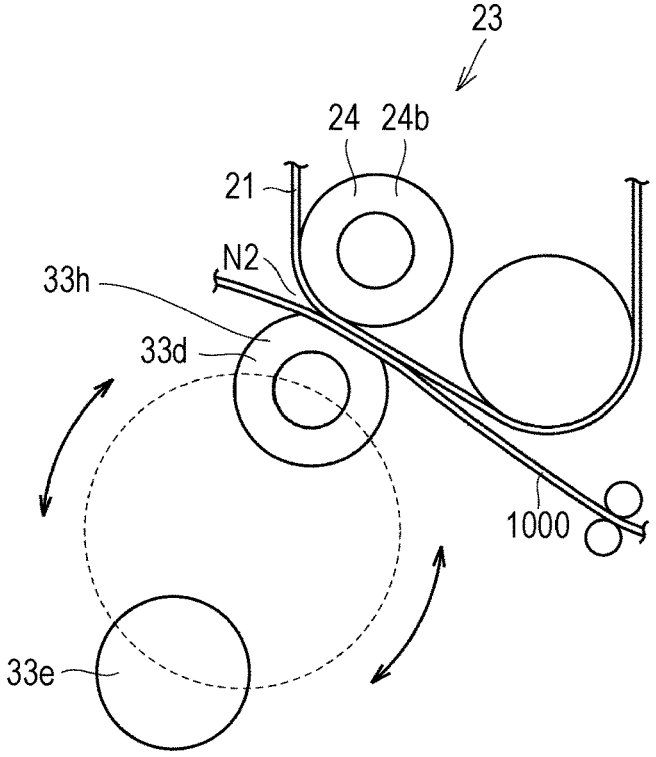
FIG. 14 is a schematic diagram of a secondary transferrer according to a third embodiment.

FIG. 14 is a schematic diagram of a secondary transferrer 23 according to a third embodiment. The secondary transferrer 23 includes a plurality of secondary transfer rollers 33 having different grades of hardness. The secondary transfer roller 33*d* illustrated in FIG. 14 has an elastic layer 33*h* on an outer peripheral surface thereof. The secondary transfer roller 33*d* has hardness lower than that of a secondary transfer roller 33*e*.

A nip width w can be adjusted by performing switching between the secondary transfer roller 33*d* and the secondary transfer roller 33*e*. In a case where the secondary transfer roller 33*d* having the lower hardness is selected, the nip width w becomes large. In a case where the secondary transfer roller 33*e* having the higher hardness is selected, the nip width w becomes small. In a case where capacitance of a recording medium 1000 is large, the nip time N is extended by selecting the secondary transfer roller 33*d* having the lower hardness.

A controller 101 selects, from among the plurality of secondary transfer rollers 33 having different grades of hardness, a secondary transfer roller 33 corresponding to the capacitance of the recording medium 1000 acquired by a sheet detector 9*c*, and adjusts the nip time by switching a currently-used secondary transfer roller 33 to the selected one. With this adjustment, transfer efficiency can be secured for various kinds of recording media 1000. Furthermore, similar to a secondary transferrer 23 of a second embodiment, productivity can be prevented from being degraded.

Fourth Embodiment

In an image forming device according to a fourth embodiment, a controller 101 adjusts a time constant $\tau$ in accordance with capacitance of a recording medium acquired by a sheet detector 9*c*. The controller 101 adjusts the time constant by changing combined capacitance $C_{total}$.

Figure 15:
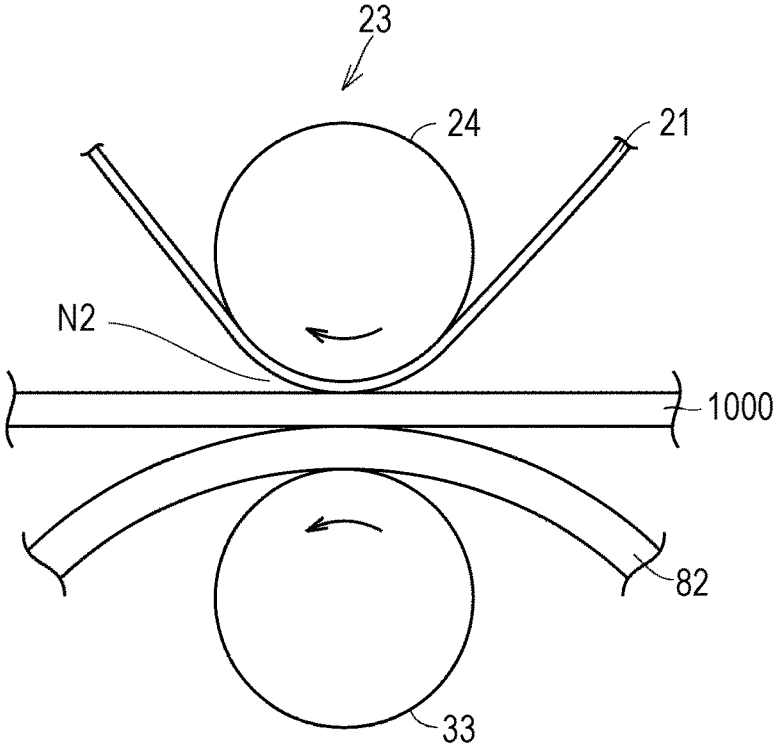
FIG. 15 is a schematic diagram of a secondary transferrer according to a fourth embodiment.

FIG. 15 is a schematic diagram of a secondary transferrer 23 according to the fourth embodiment. The secondary transferrer 23 further includes a sheet-like dielectric 82 having predetermined capacitance. When the capacitance of the dielectric 82 serving as an auxiliary sheet is defined as Ca, the combined capacitance Cs of the capacitance of the recording medium 1000 and the capacitance of the dielectric 82 is expressed by Expression (4) below. Also, the combined capacitance $C_{total}$ including capacitance $C_{toner}$ of toner is expressed by Expression (5) below.

$$Cs=C_{med}\times Ca/(C_{med}+Ca) \quad (4)$$

$$C_{total}=Cs\times C_{toner}/(Cs+C_{toner}) \quad (5)$$

When the capacitance $C_{med}$ of the recording medium 1000 is excessively large, the combined capacitance Cs can be reduced by inserting the dielectric 82 having appropriate capacitance Ca. As a result of reducing the combined capacitance Cs, the combined capacitance $C_{total}$ can be reduced and the time constant $\tau$ ($=R_{total}\times C_{total}$) can be reduced. As a material of the auxiliary sheet (dielectric 82), polyethylene (PE), polyethylene terephthalate (PET), polyimide (PI), polycarbonate (PC), acrylonitrile butadiene styrene (ABS), a polyvinylidene fluoride (PVDF) resin, or the like can be used.

The controller 101 adjusts the time constant by inserting the dielectric 82 between the recording medium 1000 and the secondary transfer roller 33 and changing the combined capacitance $C_{total}$ in accordance with the capacitance of the recording medium 1000. With this adjustment, transfer efficiency can be secured for various kinds of recording media 1000.

Additionally, since the dielectric 82 is inserted between the secondary transfer roller 33 and the recording medium 1000, the recording medium 1000 is electrostatically attracted to the dielectric 82. As a result, a conveyance path of the recording medium 1000 at the time of passing through a secondary transfer nip N2 is stabilized. Consequently, even in a case of a recording medium 1000 having a small thickness, it is possible to prevent unexpected electric discharge caused by fluctuation (fluttering) of a position of the recording medium 1000 at an entrance and an exit of the secondary transferrer 23, and the image quality is stabilized.

Fifth Embodiment

Figure 16:
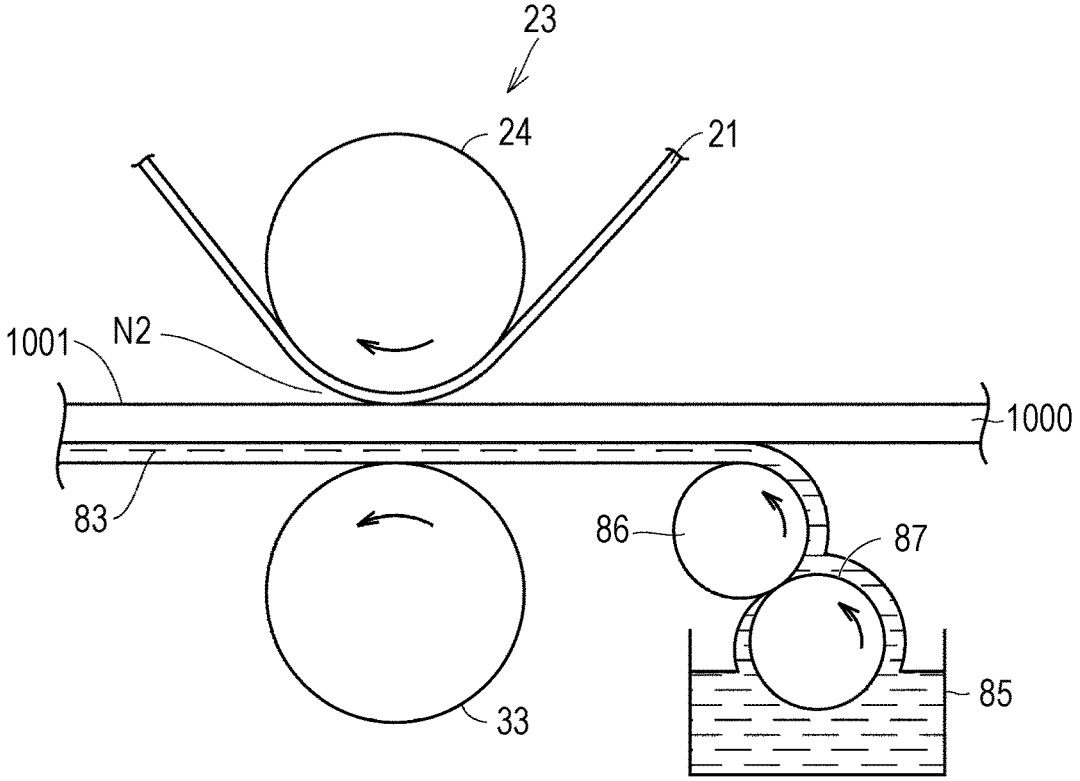
FIG. 16 is a schematic diagram of a secondary transferrer according to a fifth embodiment.

FIG. 16 is a schematic diagram of a secondary transferrer 23 according to a fifth embodiment. The secondary transferrer 23 includes an application roller 86, a scooping roller 87, and a dielectric material 85. As the dielectric material 85, liquid or fine particles can be used. As the dielectric material 85, liquid or powder having a relatively low dielectric constant and a high insulating property is used.

As the liquid, hydrocarbon series (liquid paraffin), animal and vegetable oil, mineral oil and the like can be used. For example, there are white oil of Matsumura Oil, IP Solvent of Idemitsu Kosan, Isopar (registered trademark) of Exxon Mobil, and the like. Additionally, vegetable oil (soybean oil, linseed oil, tung oil) or silicone oil may also be used. As the fine particles, for example, fine particles of polypropylene and acrylic can be used.

The scooping roller 87 scoops the dielectric material 85 from a container and applies the dielectric material 85 to the application roller 86. The application roller 86 applies the dielectric material 85 to a surface opposite to a recording surface 1001.

The applied dielectric material 85 functions as a dielectric layer 83 on a recording medium 1000. The dielectric layer 83 has predetermined capacitance. In a case of defining capacitance of the dielectric layer 83 as Cy, combined capacitance Ct of the capacitance of the recording medium 1000 and the capacitance of the dielectric layer 83 is expressed by Expression (6) below.

$$Ct=C_{med}\times Cy/(C_{med}+Cy) \quad (6)$$

The combined capacitance Ct can be changed by forming the dielectric layer 83 by application of the dielectric material 85 on the basis of an idea similar to a secondary transferrer 23 of a fourth embodiment. In a case where capacitance $C_{med}$ of a recording medium is large, the combined capacitance Ct can be reduced by applying the dielectric material 85 to the recording medium 1000.

A controller 101 changes the combined capacitance Ct by applying the dielectric material 85 to the surface of the recording medium 1000 or a surface of a secondary transfer roller 33. With this adjustment, transfer efficiency can be secured for various kinds of recording media 1000.

Furthermore, since the dielectric material 85 having small-diameter particles is applied to the surface of the recording medium 1000 or the surface of the secondary transfer roller 33, the particles enter irregularities on the surface of the recording medium 1000. Consequently, the number of air layers existing in the irregularities on the surface of the recording medium 1000 is reduced. Therefore, electric discharge can be reduced and transfer efficiency can be improved.

Sixth Embodiment

Figure 17:
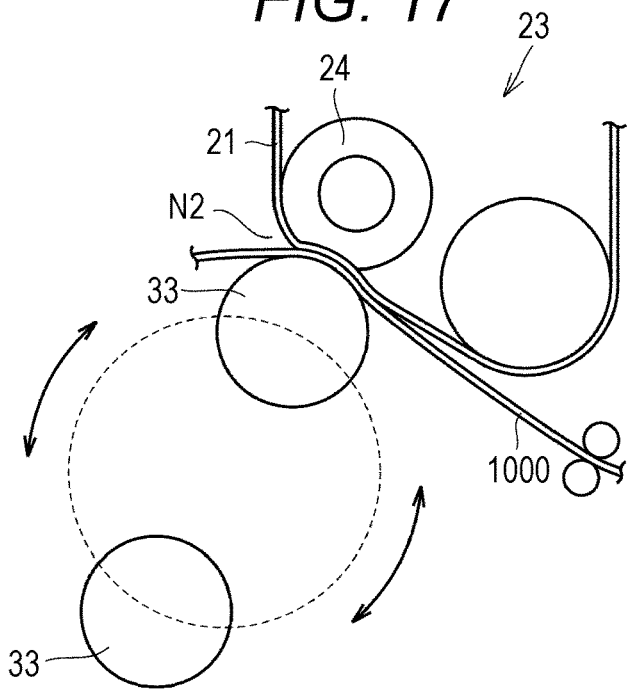
FIG. 17 is a schematic diagram of a secondary transferrer according to a sixth embodiment.

A controller 101 according to a sixth embodiment adjusts a time constant by changing a combined resistance $R_{total}$. FIG. 17 is a schematic diagram of a secondary transferrer 23 according to the sixth embodiment. The secondary transferrer 23 includes a plurality of secondary transfer rollers 33 having different resistances. A combined resistance $R_{total}$ in an equivalent circuit of the secondary transferrer 23 can be adjusted by switching a secondary transfer roller 33 among the plurality thereof.

In a case where capacitance of a recording medium 1000 is small, a roller having a relatively high resistance is used, and in a case where a capacitance of a recording medium 1000 is large, a roller having a relatively low resistance is used.

In the case where the capacitance of the recording medium 1000 is small, electric charge is accumulated faster than necessary when the roller having the low resistance is used. As a result, electric charge is excessively accumulated and electric discharge occurs, and transfer efficiency tends to be degraded.

Therefore, rather than a system only including a roller having a low resistance, it is preferable to use a system that performs switching between a roller having a low resistance and a roller having a high resistance in accordance with capacitance of a recording medium 1000.

The controller 101 selects a secondary transfer roller 33 corresponding to capacitance of a recording medium 1000 acquired by the sheet detector 9*c* from among the plurality of secondary transfer rollers 33 having different resistances, and adjusts the time constant by switching a currently-used secondary transfer roller 33 with the selected one. With this adjustment, transfer efficiency can be secured for various kinds of recording media 1000.

Furthermore, in a case of controlling constant current, simple control can be performed because a current value flowing in the equivalent circuit is not changed even when a resistance value in the equivalent circuit of the secondary transferrer 23 is changed.

Seventh Embodiment

Figure 18:
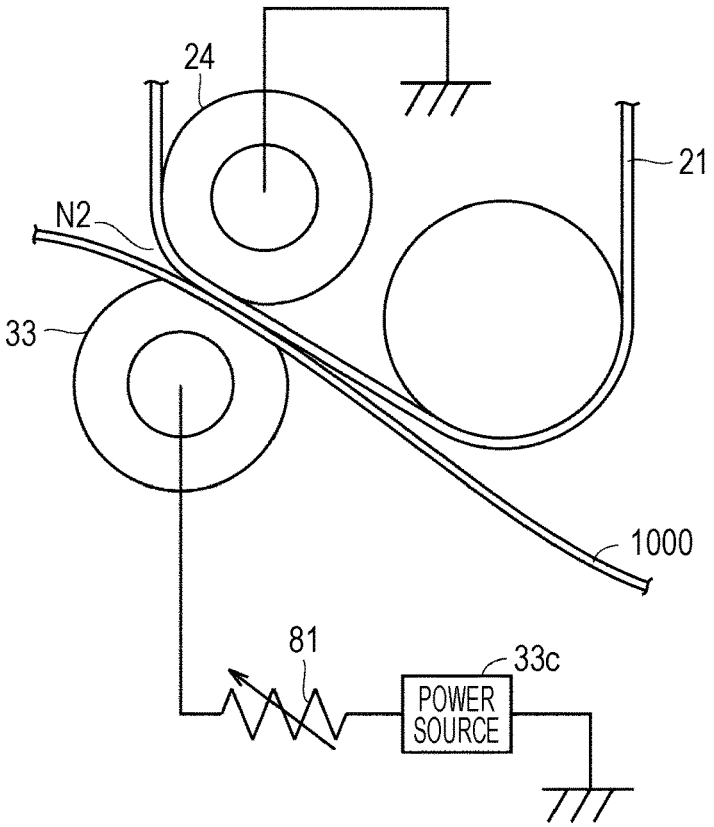
FIG. 18 is a schematic diagram of a secondary transferrer according to a seventh embodiment.

FIG. 18 is a schematic diagram of a secondary transferrer 23 according to a seventh embodiment. The secondary transferrer 23 includes an insertion resistance 81 in which a resistance value can be changed. The insertion resistance 81 is arranged between a secondary transfer roller 33 and a secondary transfer power source 33*c*. An equivalent circuit of the secondary transferrer 23 includes a resistance Rx [$\Omega \cdot m^2$] of the insertion resistance 81. In the seventh embodiment, a combined resistance is $R_{total}$=R1+R2+R3+Rx. The combined resistance $R_{total}$ in the equivalent circuit can be adjusted by changing the insertion resistance 81.

In a case where capacitance of a recording medium 1000 is large, the combined resistance $R_{total}$ in the equivalent circuit is reduced by adjusting the resistance value of the insertion resistance 81. A controller 101 adjusts a time constant by changing the resistance value of the insertion resistance 81. With this adjustment, transfer efficiency can be secured for various kinds of recording media 1000. Since the combined resistance $R_{total}$ is adjusted by the insertion resistance 81, the time constant can be changed by a simple configuration. Therefore, size increase of the device can be suppressed.

Eighth Embodiment

Like a secondary transferrer 23 in each of a second embodiment, a third embodiment, and a sixth embodiment, it may be possible to adopt a system in which a secondary transfer roller 33 to be used is automatically switched in accordance with a signal from a controller 101, however; not limited thereto, it may also be possible to adopt a system in which a user directly switches a secondary transfer roller 33 to be used.

Figure 19:
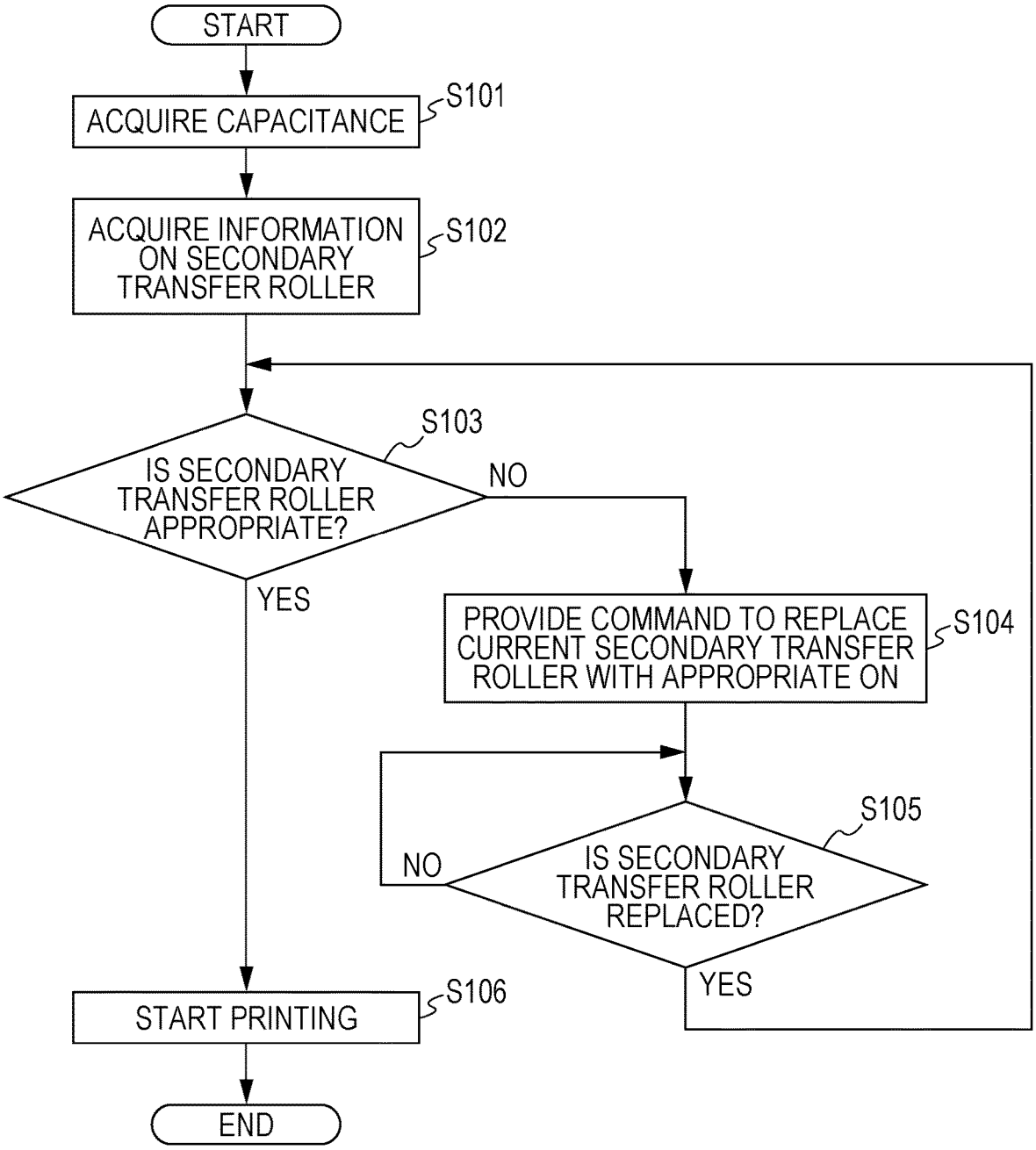
FIG. 19 is a flowchart illustrating processes in which a user performs replacement with an appropriate secondary transfer roller.

FIG. 19 is a flowchart illustrating processes in which a user performs replacement with an appropriate secondary transfer roller 33. First, in step S101, a sheet detector 9*c* acquires capacitance of a recording medium 1000 on which an image is to be formed. Next, in step S102, the controller 101 acquires information on a currently-used secondary transfer roller 33 in the secondary transferrer 23. The information on the secondary transfer roller 33 includes an outer diameter, hardness, a resistance value, and the like of the secondary transfer roller 33.

Next, in step S103, the controller 101 determines whether the currently-used secondary transfer roller 33 is appropriate by referring to a lookup table (LUT). Whether the secondary transfer roller 33 is appropriate is determined by whether transfer efficiency can be secured by the currently-used secondary transfer roller 33 for recording medium 1000 on which an image is to be formed (the same is applied to determination on whether the secondary transfer roller 33 is appropriate in the following).

In a case where the currently-used secondary transfer roller 33 in the secondary transferrer 23 is appropriate (YES in step S103), the controller 101 starts printing in step S106. In a case where the roller set in the secondary transferrer 23 is not appropriate (NO in step S103), the controller 101 displays, on a display 16, a message to replace the currently-used secondary transfer roller 33 with an appropriate secondary transfer roller 33 in step S104 in accordance with capacitance of a recording medium 1000 acquired by the sheet detector 9*c*.

The appropriate secondary transfer roller 33 is a secondary transfer roller 33 that can secure transfer efficiency for the recording medium 1000 on which an image is to be formed. The secondary transfer roller 33 for replacement is prepared outside the image forming device 2. The secondary transfer roller 33 for replacement is a secondary transfer roller 33 in which at least one of an outer diameter, hardness, and a resistance differs from that of the currently-used secondary transfer roller 33.

After the message to perform replacement with the appropriate secondary transfer roller 33 is displayed on the display 16, whether the secondary transfer roller 33 is replaced is determined in step S105. The determination in step 105 is repeated until the secondary transfer roller 33 is replaced by a user.

After replacement of the secondary transfer roller 33, the processing returns to step S103, and whether the secondary transfer roller 33 is appropriate is determined again. In a case where the secondary transfer roller 33 after replacement is appropriate (YES in step S103), the controller 101 starts printing in step S106.

Since provided is the system in which a user directly switches the secondary transfer roller 33 to be used, there is no need to arrange, inside the image forming device 2, a secondary transfer roller 33 for replacement. With this structure, the image forming device 2 can be made compact.

EXAMPLES

An image forming device (digital printing machine: bizhub PRESS C8000) manufactured by Konica Minolta, Inc. was used, and is remodeled by connecting a sheet feeding device and a roll-up device as illustrated in FIG. 1 to the image forming device such that a long sheet P could be passed through and an image was actually formed thereon.

A secondary transfer roller had a diameter of 40 mm. A core metal of the secondary transfer roller had a diameter of 24 mm. An elastic layer made of rubber was provided around the metal core. A material of the elastic layer was nitrile butadiene rubber (NBR). The elastic layer had hardness of 40 degrees that was measured by a micro rubber hardness tester (MD-1 manufactured by Kobunshi Keiki Co., Ltd.). The elastic layer had a volume resistivity of about $1\times10^8$ $\Omega\cdot$cm.

The volume resistivity of the elastic layer of the secondary transfer roller was obtained by measuring an elastic layer formed in a flat plate shape with composition same as that of the roller by using a URS probe with a resistivity meter (Hiresta-UX MCP-HT800 manufactured by Mitsubishi Chemical Analytech Co., Ltd.). Applied voltage was 100 V, and a voltage application period was 10 seconds.

A length of the secondary transfer nip parallel to an axial direction of the secondary transfer roller was 340 mm. A material of the intermediate transfer belt was polyimide. The intermediate transfer belt had a thickness of 80 μm. The intermediate transfer belt had a volume resistivity of about $1\times10^9$ $\Omega\cdot$cm.

The volume resistivity of the intermediate transfer belt was measured by using a URS probe with the resistivity meter (Hiresta-UX MCP-HT800 manufactured by Mitsubishi Chemical Analytech Co., Ltd.). Applied voltage was 100 V, and a voltage application period was 10 seconds.

The secondary transferrer had a nip width w of 3.8 mm. To measure the nip width w, a CCD camera was installed such that the secondary transferrer could be observed, and a width in which the secondary transfer roller contacted the counter roller via the intermediate transfer belt and a recording medium was acquired from an image captured by photographing the nip during image forming.

Capacitance of the recording medium was measured by using an LCR meter (LCR meter 4263B manufactured by HEWLETT PACKARD CORPORATION) at a frequency of 1 kHz and voltage of 1 V. Capacitance of the dielectric 82 in Example 4 was also measured in a similar manner.

Capacitance of toner layer was 1.33 μF/m$^2$. The capacitance $C_{toner}$ F/m$^2$ of the toner layer was derived by $C_{toner}=\varepsilon_0\varepsilon_r\times S/dt$. A relative dielectric constant $\varepsilon_r$ of the toner layer was 2.1. A thickness dt of the toner layer was 13 μm. A dielectric constant $\varepsilon_0$ of vacuum was $8.854\times10^{-12}$. A cross sectional area S of an equivalent circuit was set to 1 m$^2$. Capacitance of the dielectric layer 83 in Example 5 was also similarly derived.

Evaluation was made by measuring transfer efficiency of a solid image. Specifically, a solid image of one color (cyan) was formed and was formed as a test toner image on the intermediate transfer belt. A material of the recording medium was polyethylene terephthalate (PET) or polypropylene (PP).

"Lumirror (registered trademark)" manufactured by Toray Industries, Inc. was used as a PET film. "Torayfan (registered trademark)" manufactured by Toray Industries, Inc. was used as a PP film. As a film shape, a roll type was used. Transfer efficiency was evaluated for each of PP films respectively having various thicknesses and each of PET films respectively having various thicknesses.

The transfer efficiency was calculated by Expression (7) below while measuring: mass A of toner before transfer to the recording medium; and mass B of toner remaining on the intermediate transfer belt after transfer to the recording medium. In a case where the transfer efficiency was 95% or more, a determination result was "Good", in a case where the transfer efficiency was 90% or more and less than 95%, a determination result was "Allowable", and in a case where the transfer efficiency was less than 90%, a determination result was "No Good".

$$\text{Transfer efficiency [\%]}=((A-B)/A)\times100 \quad (7)$$

Example 1

FIG. 20 is a table illustrating evaluation results of Example 1. In Example 1, a system speed was changed in accordance with capacitance of various kinds of recording media 1000. Good transferability was obtained for each system speed.

Comparative Example 1

FIG. 21 is a table illustrating evaluation results of Comparative Example 1. In Comparative Example 1, a system speed was fixed at 400 mm/s regardless of a kind of a recording medium. Since the smaller a thickness of a recording medium is, the larger capacitance is, it is necessary to extend a nip time in accordance with capacitance/in order to secure transfer efficiency. In Comparative Example 1, in a case of using a PET or PP film having the thickness of 25 μm or less, the transfer efficiency was evaluated as "No Good".

According to Example 1 and Comparative Example 1, it was found that good transferability could be obtained for the recording media 1000 which were different in thicknesses and materials by adjusting the nip time by changing the system speed in accordance with capacitance of each recording medium 1000.

Example 2

FIG. 22 is a table illustrating evaluation results of Example 2. In Example 2, a secondary transfer roller 33 having an outer diameter of 100 mm and a secondary transfer roller 33 having an outer diameter of 40 mm were produced. Image evaluation was made by changing a secondary transfer roller 33 to be used in accordance with a kind of a recording medium 1000. The secondary transfer roller 33 having the diameter of 40 mm was same as those used in Example 1 and Comparative Example 1.

In the secondary transfer roller 33 having the diameter of 100 mm, a rubber layer was formed around a core metal having a diameter of 84 mm. At this point, the rubber layer of the secondary transfer roller 33 having the diameter of 100 mm was made to have hardness and a resistance same as those of a rubber layer used in the secondary transfer roller 33 having the diameter of 40 mm. The system speed was fixed at 400 mm/s.

As illustrated in FIG. 22, transfer efficiency was evaluated by switching the secondary transfer roller 33 to the one having the diameter of 100 mm for PET films respectively having thicknesses of 12 μm, 23 μm, and 50 μm and PP films respectively having thicknesses of 20 μm and 25 μm, and the transfer efficiency was evaluated as "Allowable" or better in all of the recording media 1000.

When the outer diameter of the secondary transfer roller 33 was increased, the nip width became longer and the nip time was extended. According to Example 2 and Comparative Example 1 (secondary transfer roller 33 having the diameter of 40 mm), it was found that good transferability could be obtained for the recording media 1000 which were different in thicknesses and materials by adjusting the nip time by changing the outer diameter of the secondary transfer roller 33 in accordance with capacitance of each recording medium 1000.

Example 3

FIG. 23 is a table illustrating evaluation results of Example 3. In Example 3, a secondary transfer roller 33 having hardness of 40 degrees and a secondary transfer roller 33 having hardness of 23 degrees were produced. Image evaluation was made by changing a secondary transfer roller 33 to be used in accordance with a kind of a recording medium 1000. The secondary transfer roller 33 having the hardness of 40 degrees was same as those used in Examples 1, 2 and Comparative Example 1.

Similar to the roller having the hardness of 40 degrees, the roller having the hardness of 23 degrees was a roller having a diameter of 40 mm and provided with an elastic layer made of nitrile butadiene rubber (NBR) around a core metal having a diameter of 24 mm. The hardness was adjusted by adjusting an amount of a cross-linker or monomer added to the rubber layer. The hardness was measured by using the micro rubber hardness tester (MD-1 manufactured by Kobunshi Keiki Co., Ltd.). The system speed was fixed at 400 mm/s.

As illustrated in FIG. 23, transfer efficiency was evaluated by switching the secondary transfer roller 33 to the one having the hardness of 23 degrees for the PET films respectively having thicknesses of 12 μm, 23 μm and 50 μm and the PP films respectively having thicknesses of 20 μm and 25 μm, and the transfer efficiency was evaluated as "Allowable" or better in all of the recording media 1000.

Since the secondary transfer roller 33 was made softer, the nip width became larger and the nip time was extended. According to Example 3 and Comparative Example 1 (secondary transfer roller 33 having the hardness of 40 degrees), it was found that good transferability could be obtained for various kinds of recording media 1000 by adjusting the nip time by changing the hardness of the secondary transfer roller 33 in accordance with capacitance of each recording medium.

Example 4

FIG. 24 is a table illustrating evaluation results of Example 4. In Example 4, the dielectric 82 was inserted between the secondary transfer roller 33 and a recording medium 1000. Specifically, the sheet-like dielectric 82 cut into an appropriate size was conveyed in a state of being superimposed on the recording medium 1000, and an image was formed on the recording medium 1000. The material of the dielectric 82 was polyvinylidene fluoride (PVDF). The thickness of the dielectric 82 was 125 μm. The system speed was fixed at 400 mm/s. Combined capacitance in the equivalent circuit of the secondary transferrer 23 calculated from capacitance of the recording medium 1000 and capacitance of the dielectric 82 was specified in FIG. 24.

The dielectric 82 was inserted for each of the PET films respectively having thicknesses of 12 μm, 23 μm, and 50 μm and each of the PP films respectively having thicknesses of 20 μm and 25 μm, and transfer efficiency was evaluated as "Good" in all of the recording media 1000.

When the dielectric 82 is inserted, the combined capacitance in the equivalent circuit of the secondary transferrer 23 was reduced. As a result of the fact that the combined capacitance in the equivalent circuit was reduced, the time constant of the equivalent circuit was reduced, and electric charge required for transfer was accumulated faster.

According to Example 4 and Comparative Example 1 (having no dielectric sheet), it was found that good transferability could be obtained for various kinds of recording media 1000 by changing the combined capacitance to adjust the time constant by inserting the dielectric 82 in accordance with capacitance of each recording medium 1000.

Furthermore, in a case where the dielectric 82 was inserted between the secondary transfer roller 33 and the recording medium 1000, an image defect caused by electric discharge hardly occurs even on a recording medium 1000 having a small thickness, and high image quality was stably obtained. A CCD camera was installed inside the image forming device 2 and the vicinity of the secondary transfer nip N2 was observed, and it was found that the recording medium 1000 closely contacts the dielectric 82 and the conveyance path of the recording medium 1000 was stabilized. The reason was that the recording medium 1000 was electrostatically attracted to the dielectric 82. As a result, even on the recording medium 1000 having the small thickness, unexpected electric discharge caused by fluctuation (fluttering) of a position of the recording medium 1000 at an entrance and an exit of the secondary transferrer 23 was prevented, and the image quality was stabilized.

Example 5

FIG. 25 is a table illustrating evaluation results of Example 5. In Example 5, the dielectric material 85 was applied to the surface opposite to the recording surface 1001 before secondary transfer. As the dielectric material 85, polypropylene resin particles having a relative dielectric constant of 2.1 and an average particle size of 0.15 μm were used. The dielectric material 85 was applied such that the thickness of the dielectric layer 83 became about 12 μm. The system speed was fixed at 400 mm/s. The combined capacitance in the equivalent circuit of the secondary transferrer 23 calculated from capacitance of the recording medium 1000 and capacitance of the dielectric layer 83 was specified in FIG. 25.

The dielectric material was applied to PP films respectively having a thickness of 20 μm and 25 μm, and transfer efficiency was evaluated "Allowable" or better in all of the recording media 1000.

When the dielectric material was applied, the combined capacitance in the equivalent circuit of the secondary transferrer 23 was reduced. As a result of the fact that the combined capacitance was reduced, the time constant of the equivalent circuit was reduced, and electric charge required for transfer was accumulated faster.

According to Example 5 and Comparative Example 1 (having no application of dielectric material), it was found that good transferability could be obtained for the recording media 1000 which were different in thicknesses and materials by changing the combined capacitance to adjust the time constant by applying the dielectric material in accordance with capacitance of each recording medium 1000.

Furthermore, in a case of applying the dielectric material 85 to each recording medium 1000, transfer efficiency was hardly degraded by electric discharge even during high voltage application. This was caused by a fact that the particles entered irregularities on a surface of the recording medium 1000 and the number of air layers existing in the regularities on the surface of the recording medium 1000 was reduced.

Example 6

FIG. 26 is a table illustrating evaluation results of Example 6. In Example 6, a secondary transfer roller 33 having a standard resistance and a secondary transfer roller 33 having a lower resistance were produced, and image evaluation was made by changing a secondary transfer roller 33 to be used in accordance with a recording medium 1000.

The secondary transfer roller 33 having the standard resistance was same as those used in Examples 1 to 5 and Comparative Example 1. Same as the roller having the standard resistance roller, the roller having the low resistance is the roller having the diameter of 40 mm and provided with the elastic layer made of nitrile butadiene rubber (NBR) around the core metal having the diameter of 24 mm.

The resistance was adjusted by adjusting an amount of the conductive agent added to the rubber layer. A volume resistivity of the elastic layer of the roller having the standard resistance resulted in about $1\times10^8$ Ω·cm and a volume resistivity of the elastic layer of the roller having the low resistance resulted in about $2\times10^7$ Ω·cm. The system speed was fixed at 400 mm/s. A combined resistance in the equivalent circuit calculated from a resistance of a secondary transfer roller 33 and a resistance of the intermediate transfer belt 21 was specified in FIG. 26.

Transfer efficiency was evaluated by switching the secondary transfer roller 33 to the one having the low resistance for the PET films respectively having thicknesses of 12 μm, 23 μm, and 50 μm and the PP films respectively having thicknesses of 20 μm and 25 μm, and the transfer efficiency evaluated as "Good" in all of the recording media 1000.

When the resistance of the secondary transfer roller 33 was low, the combined resistance in the equivalent circuit of the secondary transferrer 23 was reduced, and the time constant was reduced. When the time constant of the equivalent circuit was reduced, electric charge required for transfer is accumulated faster.

In Example 6 and Comparative Example 1 (secondary transfer roller 33 having the standard resistance), it was found that good transferability could be obtained for various kinds of recording media 1000 by adjusting the time constant by changing the resistance of the secondary transfer roller 33 in accordance with capacitance of each recording medium 1000.

Example 7

FIG. 27 is a table illustrating evaluation results of Example 7. In Example 7, experiments were performed by changing a secondary transfer roller 33 to have a resistance lower than that of the secondary transfer roller 33 used in Example 6 and then inserting the insertion resistance 81 between the secondary transfer roller 33 and the secondary transfer power source 33*c*.

A resistance value of the insertion resistance 81 was selected as illustrated in FIG. 27, considering capacitance of each recording medium 1000 to be used. When the value of the insertion resistance is changed, a combined resistance in the equivalent circuit of the secondary transferrer 23 was changed, and a time constant was also changed. In Example 7, good transferability was obtained in each of the insertion resistance values.

Comparative Example 2

FIG. 28 is a table illustrating evaluation results of Comparative Example 2. In Comparative Example 2, experiments were performed by using PET films respectively having thicknesses of 12 μm and 23 μm while the insertion resistance value is fixed to 2 MΩ. Conditions other than the insertion resistance value were same as those in Example 7. Transfer efficiency was evaluated as "No Good" in both of PET films respectively having the thicknesses of 12 μm and 23 μm.

Additionally, image evaluation was made for various kinds of recording media 1000 by using the same secondary transfer roller 33 while setting the resistance to be inserted to 100 kΩ, and it was found that: in a case of using a recording medium 1000 having a relatively large thickness (in other words, having small capacitance), and noise was likely to be generated due to electric discharge.

When the combined resistance in the equivalent circuit is low in the case where the capacitance of the recording medium 1000 is small, electric charge was accumulated faster than necessary. When the electric charge was excessively accumulated, electric discharge was likely to occur and the transfer efficiency tended to be degraded. Therefore, it is preferable to use a system in which a resistance value is switched in accordance with capacitance of each recording medium 1000, rather than a system in which the resistance value of the insertion resistance is fixed at a low value.

According to Example 7 and Comparative Example 2, it was found that good transferability could be obtained for various kinds of recording media 1000 by adjusting the time constant by changing the resistance value of the insertion resistance 81 in accordance with capacitance of each recording medium 1000.

Example 8

FIG. 29 is a table illustrating evaluation results of Example 8. As illustrated in Example 8, both of the nip time N and the time constant τ may be adjusted in accordance with capacitance of each recording medium 1000. In Example 8, a secondary transfer roller 33 having a diameter of 80 mm and a secondary transfer roller 33 having a diameter of 40 mm were produced.

An amount of a conductive agent to be added to the rubber layer was adjusted such that a resistance of the secondary transfer roller 33 having the diameter of 80 mm became slightly lower than a resistance of the secondary transfer roller 33 having the diameter of 40 mm. An elastic layer of the secondary transfer roller 33 having the diameter of 40 mm had a volume resistivity of about $1\times10^8$ Ω·cm, and an elastic layer of the secondary transfer roller having the diameter of about 80 mm had a resistance of about $5\times10^7$ Ω·cm.

Image evaluation was made by changing a secondary transfer roller 33 to be used in accordance with each recording medium 1000. A system speed was fixed at 400 mm/s. No insertion resistance was provided. As illustrated in FIG. 29, the secondary transfer roller 33 was switched to the one having the diameter of 80 mm for the PET films respectively having thicknesses of 12 μm, 23 μm, and 50 μm and the PP films respectively having thicknesses of 20 μm and 25 μm, and transfer efficiency was evaluated as "Good" in all of the recording media 1000.

Since the diameter of the secondary transfer roller 33 was increased, the nip width became larger and the nip time was extended. Furthermore, since the resistance of the secondary transfer roller 33 was set low, the time constant was reduced, and electric charge necessary for transfer was accumulated faster.

A device size is increased by increasing the diameter of the secondary transfer roller 33. Additionally, required driving torque is increased by increasing the diameter of the secondary transfer roller 33. Increasing the diameter of the secondary transfer roller 33 brings the above-described demerits.

On the other hand, when the resistance of the secondary transfer roller 33 is excessively low, leakage of electric current may occur and image ununiformity may be caused in a case where the resistance of the secondary transfer roller 33 becomes excessively low in an environment having a high temperature and high humidity.

As described above, since the nip time and the time constant were changed by combination of a plurality of measures in accordance with capacitance of each recording medium 1000, a changing range of a parameter to be adjusted can be reduced smaller than in a case of using only one measure. Therefore, the demerits in increasing the diameter of the secondary transfer roller 33 can be eliminated and probability of malfunction caused by an excessively low resistance of the secondary transfer roller 33 can be suppressed.

Example 9

FIG. 30 is a table illustrating evaluation results of Example 9. In Example 9, a system speed was changed for various kinds of recording media 1000. N/τ calculated by using the nip time N and the time constant τ was specified in FIG. 30. Good image transferability was obtained under an image output condition for each of recording media 1000 having respective index values N/τ.

Comparative Example 3

FIG. 31 is a table illustrating evaluation results of Comparative Example 3. In Comparative Example 3 also, the system speed was changed for various kinds of recording media 1000. N/τ calculated by using the nip time N and the time constant τ was specified in FIG. 31. Good image transferability could not be obtained under an image output condition for each of recording media having respective index values N/τ. According to Example 9 and Comparative Example 3, it was found that good transferability could be obtained when the condition of N/τ≥3.8 is satisfied.

Meanwhile, it may be possible to adopt, instead of the secondary transferrer 23, a so-called belt-type secondary transferrer in which a secondary transfer belt is passed, in a loop shape, around a plurality of support rollers including a secondary transfer roller.

Note that, in the second, third, and sixth embodiments, the secondary transferrer 23 may include a plurality of counter rollers 24, and the controller 101 may perform switching between the plurality of counter rollers 24.

Note that the sheet detector 9*c* may detect information on a thickness, a material, and the like of a recording medium and may acquire capacitance of the recording medium on the basis of such information. Consequently, the image forming device 2 can achieve a simple configuration.

Note that the controller 101 may also acquire capacitance of a recording medium on the basis of information on a recording medium 1000 (kind of recording medium stored in the sheet feeding device 1 and the sheet feeder 51) input from the operation unit 22 of the image forming device 2. Consequently, the image forming device 2 can achieve a simple configuration.

Although embodiments of the present invention have been described and illustrated in detail, the disclosed embodiments are made for purposes of illustration and example only and not limitation. The scope of the present invention should be interpreted by terms of the appended claims, and it is intended that all modifications within meaning and scope equivalent to the claims are included.

What is claimed is:

1. An image forming device comprising:

an endless intermediate transfer belt; and a secondary transferrer that transfers a toner image carried by the intermediate transfer belt to a recording medium, wherein the secondary transferrer includes a secondary transfer roller and a counter roller that faces the secondary transfer roller and forms a secondary transfer nip, a value calculated from $w/V_{sys}$ by using a length w [mm] of the secondary transfer nip in a conveyance direction of the recording medium and a system speed $V_{sys}$ [mm/sec] is defined as a nip time N [sec], when the secondary transferrer is deemed as an equivalent circuit including a resistance R1 [$\Omega \cdot m^2$] of the secondary transfer roller, a resistance R2 [$\Omega \cdot m^2$] of the intermediate transfer belt, a resistance R3 [$\Omega \cdot m^2$] of the counter roller, and capacitance $C_{med}$ [$F/m^2$] of the recording medium, in a case where a combined resistance in the equivalent circuit is defined as $R_{total}$ [$\Omega \cdot m^2$], and combined capacitance in the equivalent circuit is defined as $C_{total}$ [$F/m^2$], a value calculated from $R_{total} \times C_{total}$ by using the combined resistance $R_{total}$ and the combined capacitance $C_{total}$ is defined as a time constant τ [sec], and the image forming device further comprises:

a sheet detector that acquires capacitance of the recording medium; and a hardware processor that adjusts at least one of the nip time and the time constant in accordance with the capacitance of the recording medium acquired by the sheet detector.

2. The image forming device according to claim 1, wherein the recording medium has a thickness of 50 μm or less.

3. The image forming device according to claim 1, wherein the recording medium is a film.

4. The image forming device according to claim 1, wherein the recording medium is a long sheet.

5. The image forming device according to claim 1, wherein the sheet detector detects information on the recording medium and acquires capacitance of the recording medium on the basis of the information.

6. The image forming device according to claim 1, wherein the hardware processor acquires capacitance of the recording medium from one of an electric current and a voltage signal obtained by applying AC bias in a state where the recording medium is interposed between a pair of electrodes on the conveyance path.

7. The image forming device according to claim 1, wherein the hardware processor adjusts the nip time.

8. The image forming device according to claim 7, wherein the hardware processor adjusts the nip time by changing the system speed.

9. The image forming device according to claim 7, wherein the secondary transferrer includes a plurality of secondary transfer rollers at least having different outer diameters or different grades of hardness, and the hardware processor selects a secondary transfer roller corresponding to the capacitance of the recording medium acquired by the sheet detector from among the plurality of secondary transfer rollers at least having the different outer diameters or the different grades of hardness, and adjusts the nip time by switching a currently-used secondary transfer roller to the selected secondary transfer roller.

10. The image forming device according to claim 7, further comprising a display on which a command from the hardware processor is displayed, wherein the hardware processor displays, on the display in accordance with the capacitance of the recording medium acquired by the sheet detector, a message to replace a currently-used secondary transfer roller with a secondary transfer roller prepared outside the image forming device and corresponding to the capacitance of the recording medium.

11. The image forming device according to claim 10, wherein the secondary transfer roller corresponding to the capacitance of the recording medium differs from the currently-used secondary transfer roller in having at least a different outer diameter or a different grade of hardness.

12. The image forming device according to claim 1, wherein the hardware processor adjusts the time constant by changing the combined resistance.

13. The image forming device according to claim 12, wherein the secondary transferrer includes a plurality of secondary transfer rollers having resistances different from each other, and the hardware processor selects a secondary transfer roller corresponding to the capacitance of the recording medium acquired by the sheet detector from among the plurality of secondary transfer rollers having the resistances different from each other, and adjusts the time constant by switching a currently-used secondary transfer roller to the selected secondary transfer roller.

14. The image forming device according to claim 12, further comprising a display on which a command from the hardware processor is displayed, wherein the hardware processor displays, on the display in accordance with the capacitance of the recording medium acquired by the sheet detector, a message to replace a currently-used secondary transfer roller with a secondary transfer roller prepared outside the image forming device and corresponding to the capacitance of the recording medium.

15. The image forming device according to claim 14, wherein the secondary transfer roller corresponding to the capacitance of the recording medium differs from the currently-used secondary transfer roller in having a different resistance.

16. The image forming device according to claim 12, wherein the secondary transferrer further includes an insertion resistance having a resistance value that can be changed, the equivalent circuit further includes a resistance $R_x$ [$\Omega \cdot m^2$] of the insertion resistance, and the hardware processor adjusts the time constant by changing a resistance value of the insertion resistance.

17. The image forming device according to claim 1, wherein the hardware processor adjusts the time constant by changing the combined capacitance.

18. The image forming device according to claim 17, wherein the secondary transferrer further includes a sheet-like dielectric having predetermined capacitance, and the hardware processor changes the combined capacitance by inserting the dielectric between the recording medium and the secondary transfer roller.

19. The image forming device according to claim 17, wherein the secondary transferrer further includes a dielectric material that provides a dielectric layer having predetermined capacitance by applying the dielectric material, and the hardware processor changes the combined capacitance by applying the dielectric material to a surface of the recording medium or a surface of the secondary transfer roller.

20. The image forming device according to claim 1, wherein $N/\tau$ calculated by using the nip time N and the time constant $\tau$ satisfies a condition of $N/\tau \geq 3.8$.

* * * * *